US011047180B2

(12) United States Patent
Jellison et al.

(10) Patent No.: US 11,047,180 B2
(45) Date of Patent: Jun. 29, 2021

(54) DOWNHOLE HOLE CLEANING JOINTS AND METHOD OF USING SAME

(71) Applicant: National Oilwell Varco, L.P., Houston, TX (US)

(72) Inventors: Michael Joseph Jellison, Houston, TX (US); Guillaume Plessis, Singapore (SG); Andrei Muradov, Houston, TX (US); John Forester Price, Navasota, TX (US); Stephen C. Hain, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 61 days.

(21) Appl. No.: 15/031,670

(22) PCT Filed: Oct. 22, 2014

(86) PCT No.: PCT/US2014/061843

§ 371 (c)(1),
(2) Date: Apr. 22, 2016

(87) PCT Pub. No.: WO2015/061502

PCT Pub. Date: Apr. 30, 2015

(65) Prior Publication Data

US 2016/0237764 A1 Aug. 18, 2016

Related U.S. Application Data

(60) Provisional application No. 61/895,463, filed on Oct. 25, 2013.

(51) Int. Cl.
*E21B 17/22* (2006.01)
*E21B 37/02* (2006.01)
(Continued)

(52) U.S. Cl.
CPC ..... *E21B 17/22* (2013.01); *E21B 17/02* (2013.01); *E21B 17/10* (2013.01); *E21B 17/1042* (2013.01); *E21B 37/02* (2013.01)

(58) Field of Classification Search
CPC ..... E21B 17/22; E21B 37/02
See application file for complete search history.

(56) References Cited

U.S. PATENT DOCUMENTS 2,325,811 A * 8/1943 Terrell, Jr. ..... E21B 17/00 166/243
2,754,160 A * 7/1956 Owen ..... E21B 17/22 166/241.2

(Continued)

FOREIGN PATENT DOCUMENTS

EA 201070982 A1 2/2011
EP 866209 B1 6/2003

(Continued)

OTHER PUBLICATIONS

EP Office Action dated Sep. 8, 2017, for European patent application No. 14796620.4 (4 pgs.).

(Continued)

*Primary Examiner* — Steven A MacDonald
(74) *Attorney, Agent, or Firm* — Conley Rose, P.C.

(57) ABSTRACT

A hole cleaning joint for a drill string is deployed into a wellbore penetrating a subterranean formation. The hole cleaning joint includes a tubular body connectable to the drill string and a hole cleaning section positionable about the tubular body. The hole cleaning section has an outer surface engageable with a wall of the well bore. The outer surface has spiral grooves extending therein defining blades therebetween, and an uphole end and a downhole end with a spiral cavity therebetween. The spiral cavity has a width that decreases towards the uphole end of the spiral cavity to (Continued)

define a tapered flow channel to receive cuttings therethrough whereby uphole movement of cuttings is facilitated during drilling.

25 Claims, 14 Drawing Sheets

(51) Int. Cl.
*E21B 17/02* (2006.01)
*E21B 17/10* (2006.01)

(56) References Cited

U.S. PATENT DOCUMENTS 3,085,639 A * 4/1963 Fitch ..... E21B 17/16 175/323
3,125,173 A * 3/1964 Fox ..... E21B 17/16 285/333
3,194,331 A * 7/1965 Arnold ..... E21B 17/16 175/323
3,285,678 A * 11/1966 Garrett ..... E21B 17/1078 175/325.2
3,554,308 A * 1/1971 Ditson ..... E21B 17/22 175/395
3,945,446 A * 3/1976 Ostertag ..... E21B 10/46 175/323
4,385,669 A * 5/1983 Knutsen ..... E21B 10/26 175/323
4,460,202 A * 7/1984 Chance ..... E21B 17/16 175/323
4,467,879 A * 8/1984 Burge ..... E21B 17/22 175/325.4
4,610,316 A * 9/1986 Boaz ..... E21B 17/22 175/323
4,664,206 A * 5/1987 Butler ..... E21B 17/22 175/325.2
4,714,584 A * 12/1987 Altman ..... G21C 7/12 376/353
4,729,438 A * 3/1988 Walker ..... E21B 17/22 175/325.2
4,811,800 A * 3/1989 Hill ..... E21B 17/20 138/118
4,874,045 A * 10/1989 Clayton ..... E21B 17/22 175/57
4,967,855 A * 11/1990 Moser ..... E21B 10/445 144/221
5,040,620 A * 8/1991 Nunley ..... E21B 7/06 138/118
5,150,757 A * 9/1992 Nunley ..... E21B 7/06 175/323
5,474,143 A * 12/1995 Majkovic ..... E21B 10/26 175/323
5,570,742 A * 11/1996 Reynolds ..... E21B 17/1042 15/104.16
5,649,603 A * 7/1997 Simpson ..... E21B 23/14 175/323
5,697,460 A 12/1997 Stewart
6,012,744 A * 1/2000 Wilson ..... E21B 17/16 285/288.1
6,056,073 A * 5/2000 Boulet ..... E21B 17/1064 175/323
RE37,167 E 5/2001 Wilson
6,223,840 B1 5/2001 Swietlik
6,349,779 B1 * 2/2002 Gilbert ..... E21B 17/10 138/177
6,732,821 B2 5/2004 Boulet
6,935,442 B2 8/2005 Boulet
7,082,997 B2 * 8/2006 Slack ..... E21B 7/20 166/241.6
7,182,160 B2 2/2007 Boulet
7,487,840 B2 2/2009 Gammage
7,845,434 B2 * 12/2010 Clayton ..... E21B 7/04 166/241.1
7,954,566 B2 * 6/2011 Yao ..... E21B 1/00 175/323
8,607,900 B1 * 12/2013 Smith ..... E21B 10/26 175/323
8,955,621 B1 * 2/2015 Eads ..... E21B 17/22 175/323
9,145,746 B1 * 9/2015 Smith ..... E21B 17/1078
9,297,209 B1 * 3/2016 Smith ..... E21B 10/26
9,562,401 B1 * 2/2017 Smith ..... E21B 17/1078
2003/0136587 A1 * 7/2003 Boulet ..... E21B 17/22 175/323
2004/0060699 A1 * 4/2004 Rastegar ..... E21B 17/1078 166/285
2006/0201670 A1 9/2006 Stewart
2006/0207796 A1 9/2006 Stewart
2006/0207801 A1 * 9/2006 Clayton ..... E21B 7/04 175/325.5
2007/0278011 A1 12/2007 Barnett
2010/0326738 A1 12/2010 Boulet
2011/0048803 A1 * 3/2011 Robson ..... E21B 17/10 175/57
2012/0067649 A1 3/2012 Wilson
2012/0073695 A1 * 3/2012 Muth ..... E21B 17/22 138/177
2014/0202770 A1 * 7/2014 Zaki ..... E21B 10/26 175/57
2014/0246247 A1 * 9/2014 Smith ..... E21B 10/26 175/394

FOREIGN PATENT DOCUMENTS

GB 2314358 12/1997
GB 2473094 3/2011
GB 2473094 A 3/2011
WO 2009095794 8/2009
WO 2013034919 3/2013
WO 2013034919 A2 3/2013

OTHER PUBLICATIONS

International Search Report and Written Opinion for PCT/US2014/061843 dated Jun. 23, 2016 (11 pages).
VAM-Drilling Hydroclean—reducing non-productive time brochure (3 pages).
VAM Drilling Hydroclean—Designed for Maximum Hole Cleaning While Drilling High Angle Wells (2 pages).
Puymbroeck, Luc Van, Drill pipe design targets ERD hole cleaning | Drilling Contractor, Drillingcontractororg, (2 pages).
Puymbroeck, Luc Van, et al., Increasing Drilling Performance for ERD Wells using New Generation hydro-Mechanical Drill Pipe, American Association of Drilling Engineers, AADE-13-FTCE-01, (8 pages).
Russian Office Action and Search Report dated Jun. 5, 2018, and English translation, for Russian Application No. 2016119913 (16 pgs.).
Mexican Office Action published on Aug. 6, 2019 for Application No. MX/a/2016/005228, with English summary.
First Canadian Office Action dated Nov. 8, 2019, for Application No. 2,928,535.
Second Canadian Office Action dated Apr. 2, 2020, for Application No. 2,928,535.

* cited by examiner

DOWNHOLE HOLE CLEANING JOINTS AND METHOD OF USING SAME

BACKGROUND

This present disclosure relates generally to techniques for performing wellsite operations. More specifically, the present disclosure relates to tubulars, such as drill strings and drill stem components, used in downhole operations.

Oilfield operations may be performed to locate and gather valuable downhole fluids. Oil rigs are positioned at wellsites, and downhole equipment, such as a drilling tool, is deployed into the ground by a drill string to reach subsurface reservoirs. At the surface, a drilling rig is provided to deploy stands of drill pipe into the wellbore to form the drill string. A drill bit is mounted on the lower end of the drill string, and advanced into the earth from the surface to form a wellbore.

Various surface equipment, such as tongs, a top drive, a Kelly and a rotating table, may be used to threadedly connect the stands of pipe (e.g., drill pipe) together, and to apply torque to the stands of drill pipe and the drill bit. A mud pit may be located at the surface for passing drilling mud through the drill string to cool the drill bit and carry away cuttings.

The drill string may be provided with various downhole components, such as a bottom hole assembly (BHA), measurement while drilling, logging while drilling, telemetry and other downhole tools, to perform various downhole operations, such as providing power to the drill bit to drill the wellbore and perform downhole measurements.

Various downhole devices, such as stabilizers, have been provided along the drill string. Examples of downhole devices are provided in U.S. Pat. Nos. 4,610,316, 4,000,549, and RE37167.

SUMMARY

In at least one aspect, the disclosure relates to a hole cleaning joint for a drill string deployable into a wellbore penetrating a subterranean formation. The hole cleaning joint includes a tubular body connectable to the drill string and a hole cleaning section. The hole cleaning section is positionable about the tubular body, and has an outer surface engageable with a wall of the wellbore. The outer surface has spiral grooves extending therein defining blades therebetween. The spiral grooves may have an uphole end and a downhole end with a spiral cavity therebetween. At least a portion of the spiral cavity may have a width that decreases towards the uphole end of the spiral cavity to define a tapered flow channel to receive cuttings therethrough whereby uphole movement of cuttings is facilitated during drilling.

The hole cleaning joint may also include a connector at at least one end of the tubular body. The connector may be at least one of a sleeve, a coupling, an internal thread, a threaded end, a ring, a pin end, and/or a box end. A cross-section of the hole cleaning section has a pinwheel shape defined by a plurality of the blades with a plurality of spiral grooves therebetween.

The spiral grooves have a sloped portion and an inclined portion therein having a localized agitation area therein. The spiral grooves may include a pair of mirrored grooves, and/or an uphole portion, an intermediate portion, and a downhole portion with peripheral depressions therebetween. The spiral grooves have multiple pitches. The multiple pitches may include a first pitch and a second pitch, with the first pitch greater than the second pitch.

The hole cleaning joint may also include at least one ring. The at least one end of the hole cleaning section may terminate at the at least one ring. A diameter of the hole cleaning section may taper to the at least one ring. The spiral grooves may have a helical shape and/or be oriented in the direction of rotation.

A portion of the width of the spiral grooves may increase between the uphole and downhole ends thereof. The spiral groove may narrows at a location between the uphole end and the downhole end thereof. The hole cleaning section may have an end operatively connectable to a connector. The hole cleaning section may have the tubular body at one end thereof and a connector at an opposite end thereof.

The hole cleaning section may have an outer diameter that reduces or increases from an uphole end and to a downhole end thereof. An outer diameter of the hole cleaning section may be greater than or the same as an outer diameter of the tubular body. The hole cleaning section may be integral or modular with respect to the pipe body. The hole cleaning section may be weldable to at least one of the tubular body and/or at least one connector. The hole cleaning section may include a plurality of hole cleaning sections with at least one of the tubular bodies therebetween.

The spiral grooves may have an angle, width, depth, pitch, and orientation to facilitate flow of the cuttings uphole through the flow channel. The hole cleaning section may a defined outer diameter, shape, length, and orientation to facilitate flow of the cuttings uphole through the flow channel.

In another aspect, the disclosure relates to a hole cleaning system for drilling a wellbore penetrating a subterranean formation. The system includes a drill string deployable from a rig, a bottomhole assembly carried by the drill string, and a hole cleaning joint. The hole cleaning joint includes a tubular body connectable to the drill string, and a hole cleaning section positionable about the tubular body. The hole cleaning section has an outer surface engageable with a wall of the wellbore and spiral grooves extending therein defining blades therebetween. The spiral grooves have an uphole end and a downhole end with a spiral cavity therebetween. At least a portion of the spiral cavity having a width that decreases towards the uphole end of the spiral cavity to define a tapered flow channel to receive cuttings therethrough whereby uphole movement of cuttings is facilitated during drilling.

The drill string may include at least one tubular and at least one of the hole cleaning joints. The tubular may include at least one of a drill pipe, drill collars, heavy weight drill pipe, sleeve, and/or collar. The drill string may include pairs of drill pipe and a plurality of hole cleaning joints. One of the plurality of hole cleaning joints may be operatively connected to each pair of drill pipe of the drill string. The hole cleaning joint may include a plurality of the hole cleaning sections connected to at least one of the tubular bodies. The hole cleaning joint may include connectors at each end thereof matably connectable connectors of an adjacent hole cleaning joint to form at least a portion of the drill string.

In yet another aspect, the disclosure relates to a method of drilling a wellbore penetrating a subterranean formation. The method involves deploying a downhole tool from a rig via a drill string and operatively connecting at least one hole cleaning joint to the drill string. The hole cleaning joint have a hole cleaning section with spiral grooves extending into an outer surface thereof. The spiral grooves have a width that decreases towards an uphole end thereof to define a tapered flow channel therethrough. The method further involves generating cuttings by advancing a downhole tool into the subterranean formation via the drill string, facilitating flow of the cuttings to the surface by passing a drilling fluid through the drill string and up an annulus between the drill string and a wall of the wellbore such that at least a portion of the cuttings pass through the tapered flow channel of the spiral grooves.

The method may also involve agitating the cuttings in the flow channel. The operatively connecting may involve operatively connecting the at least one hole cleaning joint and at least one tubular to the drill string. The method may also involve engaging a wall of the wellbore with at least a portion of the hole cleaning joint.

Finally in another aspect, the disclosure relates to a hole cleaning joint for a drill string deployable into a wellbore penetrating a subterranean formation. The hole cleaning joint includes a tubular body connectable to the drill string and a hole cleaning section positionable about the tubular body. The hole cleaning section has an outer surface engageable with a wall of the wellbore, and spiral grooves extending therein defining blades therebetween. The spiral grooves have an uphole end and a downhole end with a spiral cavity therebetween. The spiral cavity has a sloped portion and an inclined portion with an obtuse angle therebetween defining a localized agitation area therein whereby uphole movement of cuttings is facilitated during drilling.

A cross-section of the hole cleaning section may have a pinwheel shape. The pinwheel shape may be defined by a plurality of the blades with a plurality of spiral grooves therebetween. A depth of the spiral grooves may increase between the sloped portion and the inclined portion. The spiral grooves may have a rounded corner between the sloped portion and the inclined portion. The spiral grooves may have a helical shape. The spiral grooves may be oriented in the direction of rotation.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatuses, methods, techniques, and/or instruction sequences that embody techniques of the present subject matter. However, it is understood that the described embodiments may be practiced without these specific details.

The present disclosure relates to hole cleaning joints positionable along a drill string to facilitate removal of cuttings during drilling. The hole cleaning joints may be connectable to (or integral with) various tubulars, such as drill pipe, drill collars, heavy weight drill pipe (HWDP), other joints, sleeves, collars, and drilling components, to drive a drill bit and to form the drill string for the passage of fluid (e.g., drilling mud) therethrough. The hole cleaning joints may be drill pipe or other joints and/or tubulars including hole cleaning pads (or wear pad) having hole cleaning sections with spiral grooves of various geometries (e.g., depths, widths, angles, pitches, and/or orientations).

Various configurations of one or more hole cleaning pads, hole cleaning sections, and/or other joints (or components) may be combined to form hole cleaning joints along the drill string. Various shapes and configurations of the hole cleaning joints, hole cleaning pads, and/or hole cleaning sections with grooves therein may be used, for example, to facilitate uphole movement of cuttings, optimize cuttings removal, perform hole cleaning, minimize differential sticking tendencies, reduce borehole friction, and/or enhance drilling efficiency.

Figure 1:
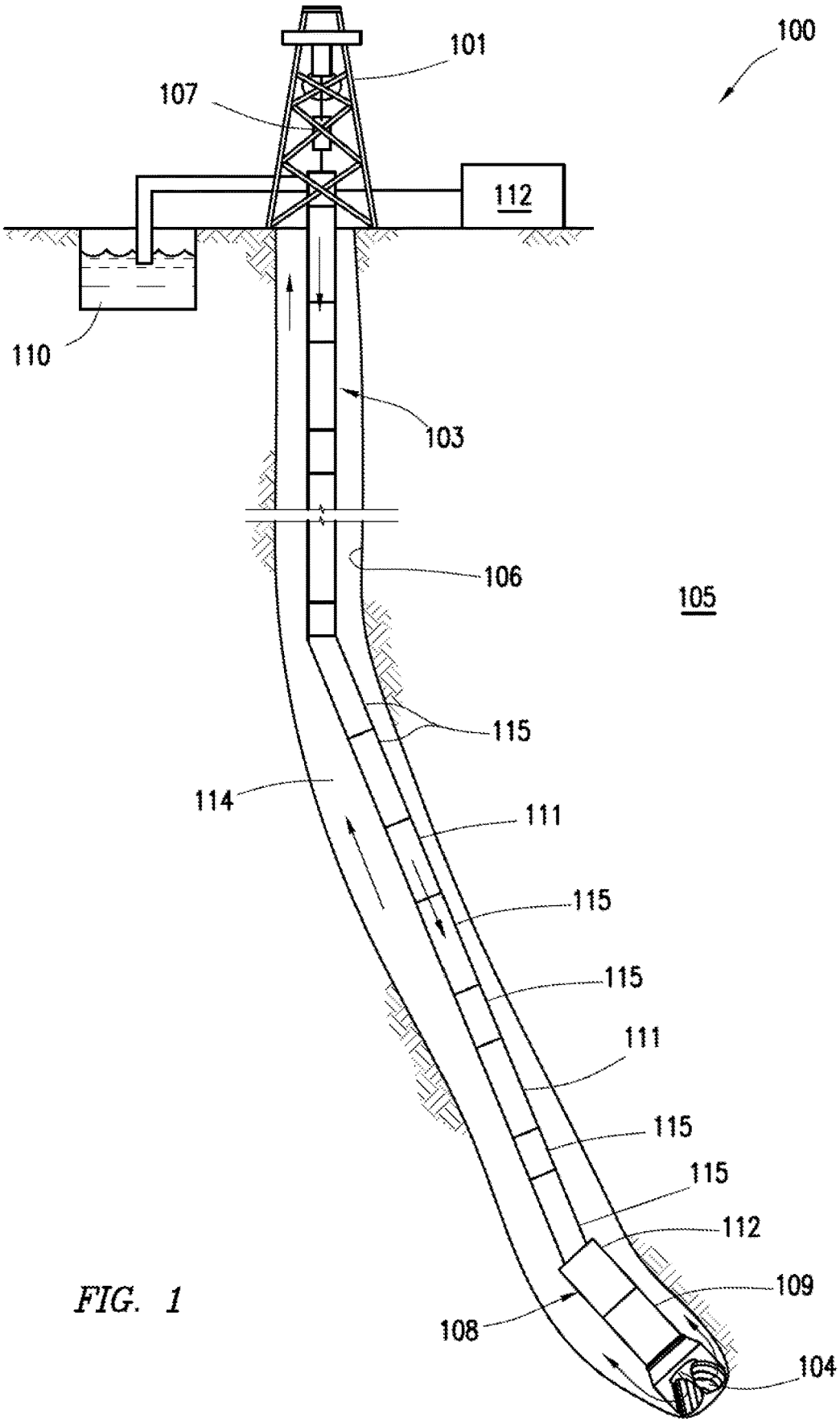
FIG. 1 depicts a schematic view, partially in cross-section, of a wellsite having a rig with a drill string advanced into a wellbore, the drill string including hole cleaning joints.

FIG. 1 is a schematic view of an example environment in which joints with hole cleaning capabilities may be used. While a land-based drilling rig with a specific configuration is depicted, the hole cleaning joints provided herein may be usable with all types of drilling operations (e.g., land or offshore applications). The hole cleaning joints provided herein may be used with all drilling applications, including high-angle directional drilling, horizontal drilling, extended reach drilling (ERD), and/or other critical drilling applications, among others.

FIG. 1 shows a wellsite 100 including a rig 101 for performing various wellbore operations, such as drilling. A drill string 103 with bit 104 at a downhole end thereof is advanced into the formation 105 to form wellbore 106. Various rig equipment 107, such as a Kelly, rotary table, top drive, elevator, etc., may be provided at the rig 101 to support and/or drive the drill string 103.

A bottom hole assembly (BHA) 108 is at a lower end of the drill string 103 and contains various downhole components for performing downhole operations. The components may include, for example, measurement while drilling, logging while drilling, telemetry, processors and/or other downhole tools. A driver, such as a downhole motor or rotary steerable system, 109 may also be provided uphole of the bit 104 for rotationally driving the bit 104. The drill string 103 includes a plurality of drill pipe joints 115 and hole cleaning joints 111.

A mud pit 110 may be provided at the surface for passing mud through the drill string 103, the BHA 108 and out the bit 104 as indicated by the arrows. Cuttings may be returned to the surface through an annulus 114 between the drill string 103 and a wall of the wellbore 106 as also indicated by arrows. A surface controller 112 is also provided at the surface to operate the wellsite 100. As shown, the BHA 108 may optionally include a downhole controller 112 for communication between the BHA 108 and the surface controller 112. One or more controllers 112 may be provided.

Figures 2A, 2B:
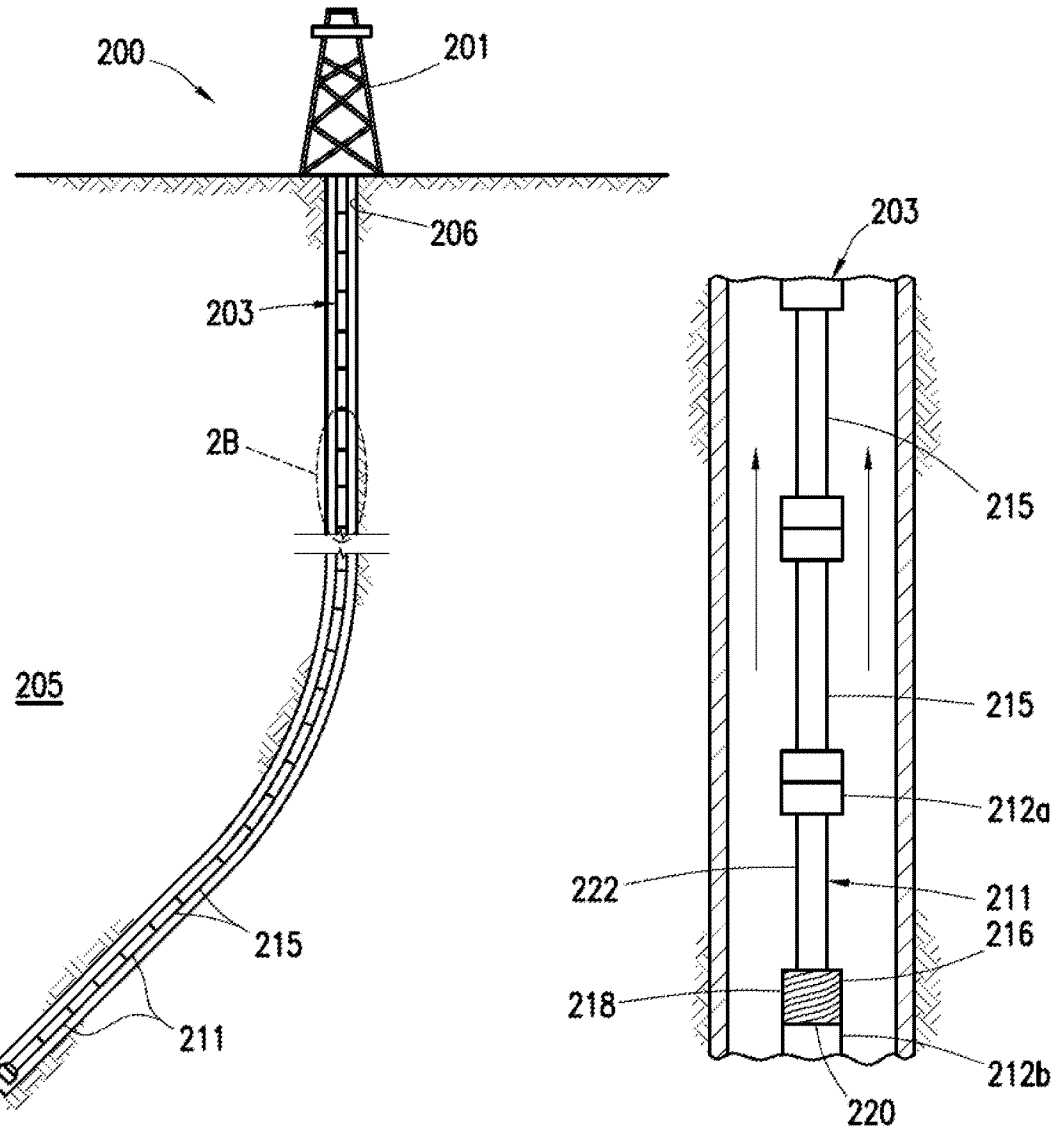
FIG. 2A depicts another schematic view, partially in cross-section, of a wellsite having a rig with a drill string advanced into the wellbore, the drill string including hole cleaning joints.
FIG. 2B depicts a portion 2B of the drill string of FIG. 2A.

FIG. 2A shows another schematic view of a wellsite 200 including a drilling rig 201 with a drill bit 204 advanced into a formation 205 by a drill string 203 (shown in detail in FIG. 2B) to form a wellbore 206. The drill string 203 includes multiple drill pipe joints 215 and multiple hole cleaning joints 211 connected end to end to form a drill string 203. As shown in the detailed portion 2B, the drill string 203 includes multiple drill pipe joints 215 followed by one hole cleaning joint 211. One or more hole cleaning joints 211 may be provided about one or more drill pipe joints 215 within the drill string 203. This example depicts that one of every three joints is a hole cleaning joint 211.

The hole cleaning joints 211 herein may be used alone or connected to adjacent tubulars, such as drill pipe joints 215, using a variety of connections to form drill string 203. Ends (or connections) 212*a,b* of the hole cleaning joint 211 may be threadedly connectable to adjacent tubulars, such as the drill pipe joint 215. In some cases, the hole cleaning joints 211 may include connectors (or connection means) that are integrally formed therewith and/or operatively connected thereto for providing the desired connections to adjacent tubulars. Examples of connectors may include sleeves, couplings, internal threads, threaded ends, pin ends and/or box ends, among others.

In the example shown, the hole cleaning joints 211 have the same pin and box type ends 212*a,b* for connection to conventional drill pipe joints. While the hole cleaning joints 211 of FIGS. 2A and 2B are shown connected to drill pipe joint 215, the hole cleaning joints 211 may be connected to adjacent tubulars that may be one or more of another (same or different) hole cleaning joint (e.g., 211), drill pipe joint (e.g., 215), and/or other tubulars.

The hole cleaning joints 211 may be any tubular, such as a drill pipe joint (e.g., 215), HWDP, and/or other tubulars. The hole cleaning joints 211 may include, for example, pin and box ends 212*a,b* with a pipe (or tubular) body 222 therebetween and a hole cleaning pad 220 along the pipe body 222. The hole cleaning pad 220 may be formed integrally with or operatively connected (e.g., by friction welding) to the pipe body 222. The hole cleaning sections 220 may be welded about the pipe body 222 between either or both ends 212*a,b*.

The hole cleaning pad 220 may have a hole cleaning section 216 provided with grooves 218 extending therein. The hole cleaning section 216 may have customized grooves 218 formed on the hole cleaning pad 220 between portions of the pipe body 222. For example, the grooves 218 may be machined into wear pad 220 on the pipe body 222 by cutting the grooves 218 into the hole cleaning pad 220. Another option is to machine customized spirals on an extended tool joint to make the pipe body 222 and the hole cleaning pad 220 an integral part. The grooves 218 and/or hole cleaning joints 211 may have profiles and geometries to address various hole cleaning issues confronted at the wellsite 200.

The hole cleaning joints 211 may be customized to promote hole cleaning in different well drilling conditions and/or to address various hole cleaning issues confronted in the well. The hole cleaning joints 211 may be customized, for example, by varying the geometry of the spiraled grooves 218 (e.g., angle, width, depth, pitch, orientation, and/or other dimensions) and/or hole cleaning section 220 (e.g., diameter, shape, length, orientation, and/or other dimensions). The geometry of the hole cleaning section 216 may be customized to optimize hole cleaning by gathering cuttings, accelerating cuttings to move up the wellbore 206, and/or enhancing cuttings dispersal throughout and up the well bore 206 as indicated by the arrows.

Variable, customized spiraled grooves 218 distributed throughout the drill string 203 may be used, for example, to provide comprehensive reduction in differential sticking tendencies for the drill string 203. For example, an angle (e.g., pitch) of the spiral grooves 218 may be varied to promote hole cleaning by facilitating cuttings pickup from downhole locations. The angle may also be used to increase annular velocity and dispersion of the cuttings towards the surface and to optimize thrust according to hole size and fluid velocity. The spiraled grooves may be oriented at an angle in the direction of rotation (e.g., clockwise for clockwise rotation). In another example, a shape of the grooves 218 may be used to facilitate hole cleaning by facilitating the removal of cuttings and reducing differential sticking tendencies by reducing contact area between the drill string 203 and a wall of the wellbore 206.

The hole cleaning pad 220 may have selected outside diameters to further customize and optimize the hole cleaning properties. Transitions between the hole cleaning pad 220 and other portions of the pipe body 222 and/or adjacent tubulars (e.g., drill pipe joint 215) having different diameters may be customizable. A gradual transition may be provided, for example, on a downhole (or leading) end of the hole cleaning section 216 to optimize accumulation or gathering of cuttings. A steep transition from the outer diameter of the hole cleaning pad 220 to the outer diameter of the pipe body 222 on an uphole (or trailing) portion of the hole cleaning section 218 may be used to promote dispersion of cuttings up the well bore 203. Variations and unique transitions (e.g., depressions and/or raised portions) may also be incorporated along various portions of the hole cleaning joint 211 to alter drilling fluid and cutting flow patterns for more favorable hole cleaning capabilities.

In some cases, the drill string 203 may be deployed through a wellsite component, such as a blowout preventer (e.g., an annular blowout preventer) positioned about a wellbore 206. The blades between grooves 218 of the hole cleaning joint 211 may be, for example, rounded and/or smoothed (e.g., along edges of the blades) to prevent damage to the blowout preventer (e.g., blades of the blowout preventer) that may be engaged when the drill string 203 is tripping into or out of the wellbore 206.

FIGS. 3A-12B depict various configurations of hole cleaning joints 311-1211. As depicted in these views, various geometries of the hole cleaning joints, hole cleaning pads, hole cleaning sections, and/or grooves may be provided.

Figure 3A:
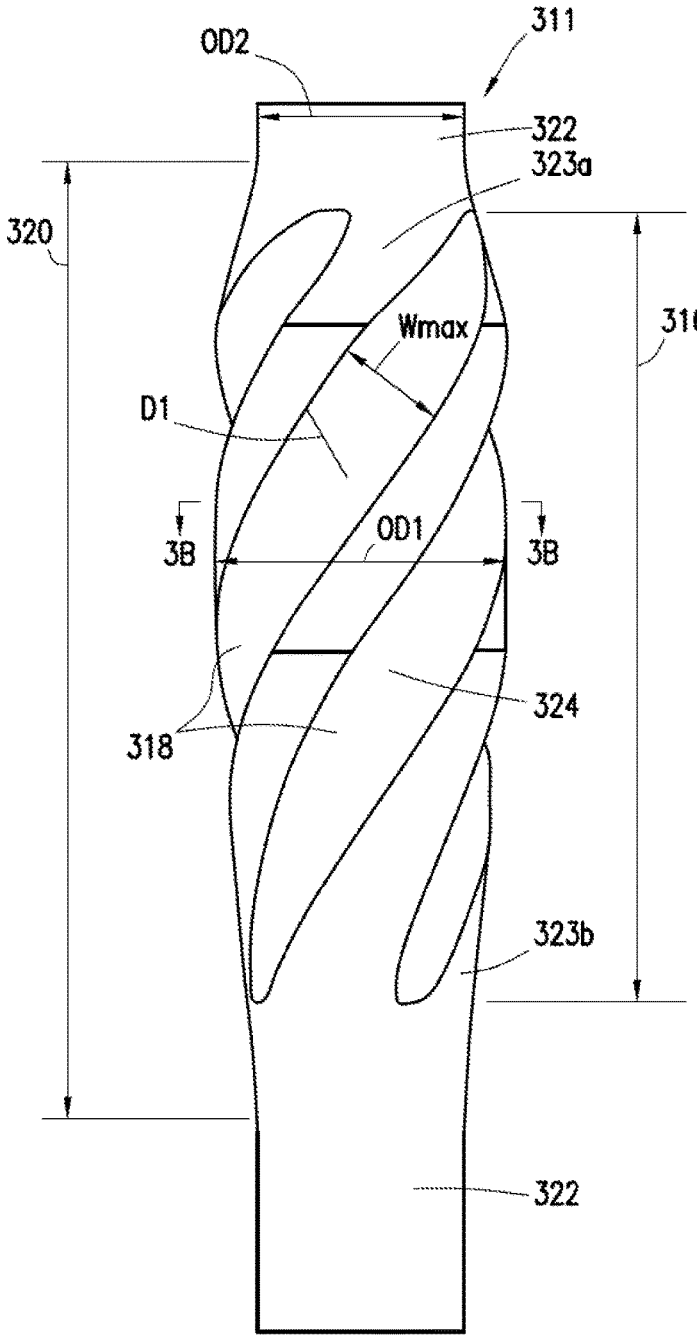
FIGS. 3A-3B depict plan and cross-sectional views, respectively, of a portion of a hole cleaning joint including a hole cleaning pad with a spiral hole cleaning section.
Figure 3B:
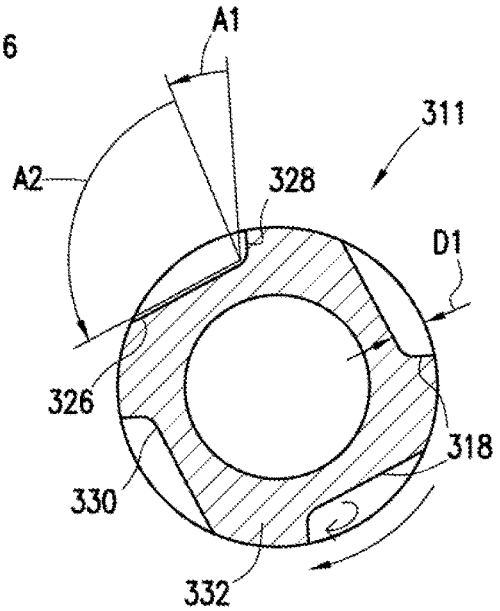

FIGS. 3A and 3B show a portion of a hole cleaning joint 311 with a hole cleaning section 316 having a spiral configuration. FIG. 3A shows a plan view of a portion of the hole cleaning joint 311. FIG. 3B shows a cross-sectional view of the hole cleaning joint 311 taken along line 3B-3B.

The portion of the hole cleaning joint 311 may be similar to the hole cleaning joint 211 of FIGS. 2A and 2B, except that the ends are not shown and a specific configuration of a hole cleaning section 316 is depicted. Pin and box ends (e.g., 212*a,b* of FIG. 2A,2B) may be provided for connection of the hole cleaning joint 311 to adjacent tubulars.

The hole cleaning joint 311 includes a pipe body (or body upset) 322 and a hole cleaning pad 320. The hole cleaning pad 320 includes tapered ends 323*a,b* with the hole cleaning section 316 therebetween. The hole cleaning pad 320 may be positioned between portions of the pipe body 322 or formed integrally therewith. The hole cleaning section 316 has spiral grooves 318 extending therein. The hole cleaning pad 320 has a maximum outer diameter OD1 along a portion of the hole cleaning section 316. The OD1 reduces along the tapered ends 323*a,b* until it reaches the pipe body 322. The pipe body has an outer diameter OD2 that is less than the outer diameter OD1.

The hole cleaning section 316 also has an outer surface 324 with the spiral grooves 318 extending therein. Multiple spiral grooves 318 of similar shape are shown positioned about the outer surface 324. The spiral grooves 318 may extend helically along a length of the hole cleaning section 316 between the tapered ends 323*a,b*. The multiple spiral grooves 318 are shown as having identical dimension (e.g., angle, width, depth, pitch, orientation, and/or other dimensions). The grooves 318 have a maximum width Wmax and depth D1 that tapers at each of the hole cleaning sections 316 and terminates at each tapered end 323*a,b* in a tapered, rounded point.

As shown by the cross-sectional view of FIG. 3B, each groove 318 may extend a distance into the outer surface 324 to define a sloped portion 326 and an inclined portion 328 with a rounded corner therebetween 330. The cross-sectional view shows the grooves 318 at a maximum depth D1 along section 3B-3B. The grooves 318 are shown as having an obtuse angle defined by angles A1, A2 as shown. A blade 332 is defined between each groove 318. The combination of blades 332 and grooves 318 creates a cross-section in the shape of a pinwheel. This pinwheel shape may be used to facilitate circulation to lift cuttings by generating localized agitation as indicated by the curved arrow within the groove 318.

Figure 4A:
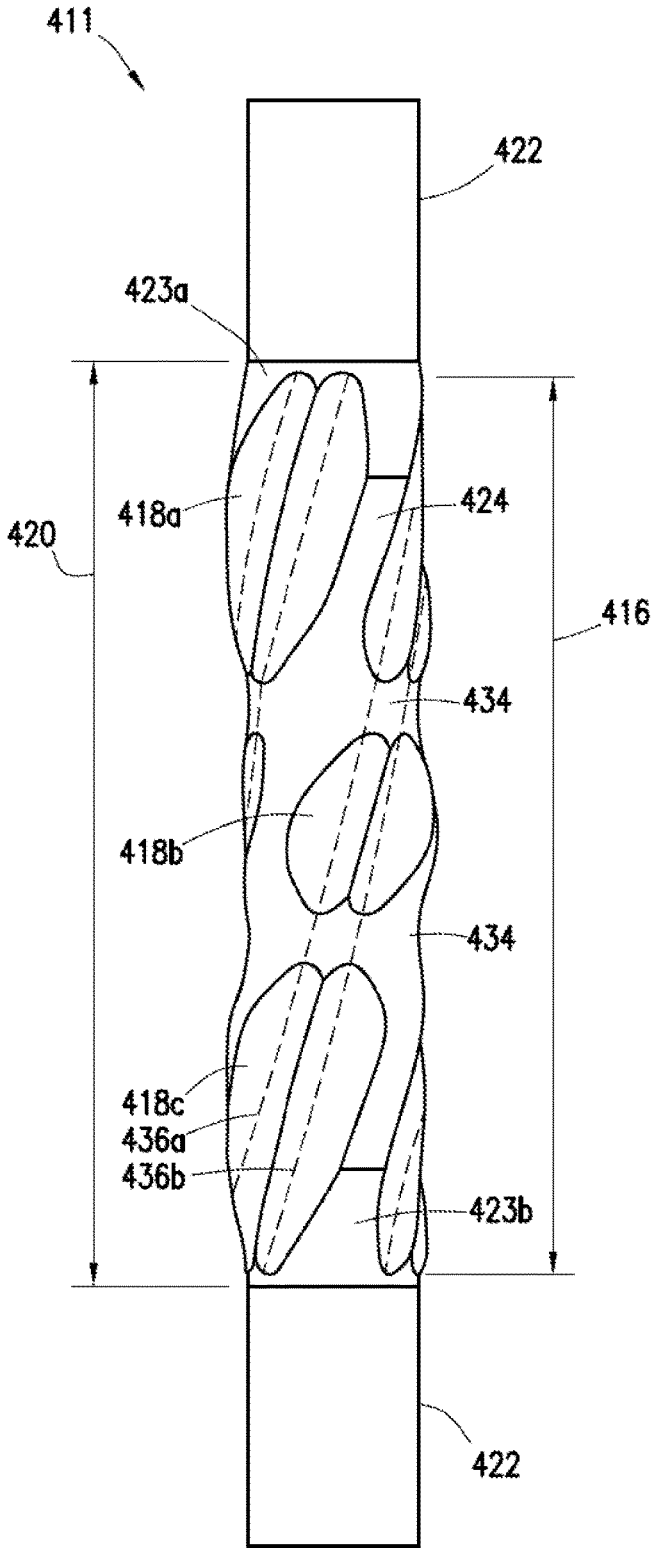
FIGS. 4A-4B depict plan and perspective views, respectively, of a portion of a hole cleaning joint including a hole cleaning pad with a segmented spiral hole cleaning section.
Figure 4B:
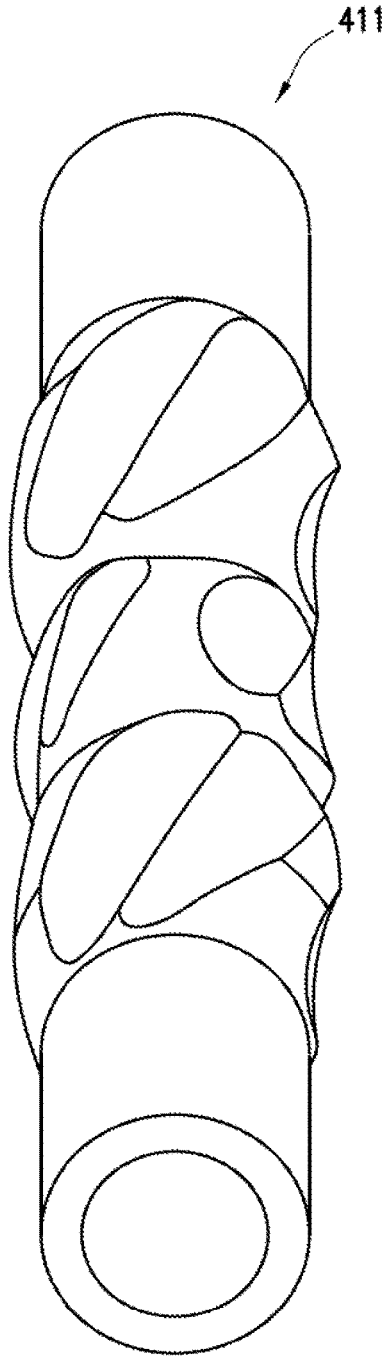

FIGS. 4A and 4B show a portion of a hole cleaning joint 411 including a hole cleaning pad 420 with a hole cleaning section 416 having a segmented spiral configuration. As shown by this view, the hole cleaning section 416 may be similar to the hole cleaning section 316, except that the hole cleaning pad 420 has a different size and shape and the grooves 418*a-c* have a different configuration. The hole cleaning pad 420 has tapered ends 423*a,b* that extend from the hole cleaning section 416 to a pipe body 422.

In this version, the hole cleaning section 416 has grooves 418*a-c* disposed about an outer surface 424 of the hole cleaning section 416. As shown in this view, the grooves 418*a,b* are in a three-tier configuration with three rows of angled grooves 418*a-c* separated by a two peripheral depressions 434. The rows of angled grooves 418*a,b,c* include an uphole row of grooves 418*a*, an intermediate row of grooves 418*b*, and a downhole row of grooves 418*c* separated by the peripheral depressions 434.

The uphole and downhole rows of grooves 418*a,c* have similar configurations having curved grooves extending into the hole cleaning section 416. The intermediate row of grooves 418*b* also extend into the hole cleaning section 416, but have a shorter length than the grooves 418*a,c*. The angled grooves 418*a,b,c* are spirally aligned about the hole cleaning section 416 to form pairs 436*a,b* of dual spirals about the hole cleaning section 416 as indicated by dashed lines. The pairs of dual spirals 436*a,b* include mirrored individual spirals 436*a,b* touching on adjacent sides.

Figure 5A:
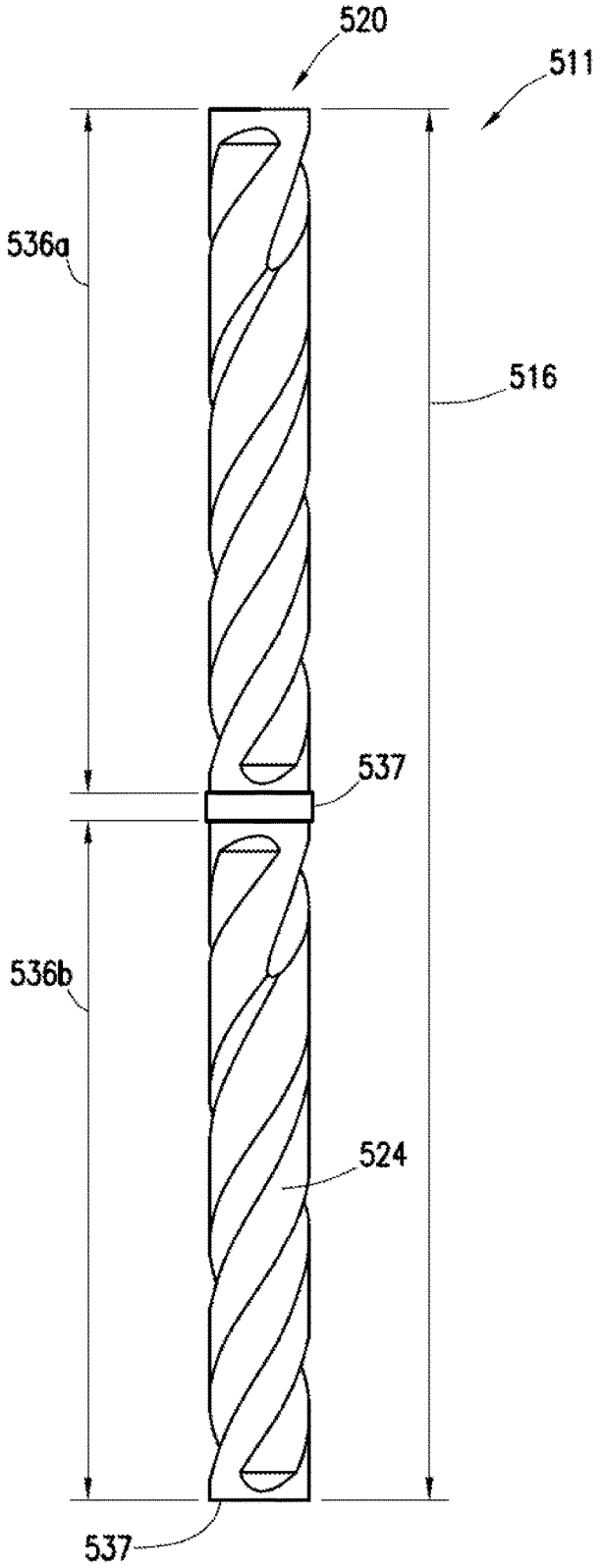
FIGS. 5A-5B depict plan and perspective views, respectively, of a portion of a hole cleaning joint including a hole cleaning pad with a dual spiral hole cleaning section.
Figure 5B:
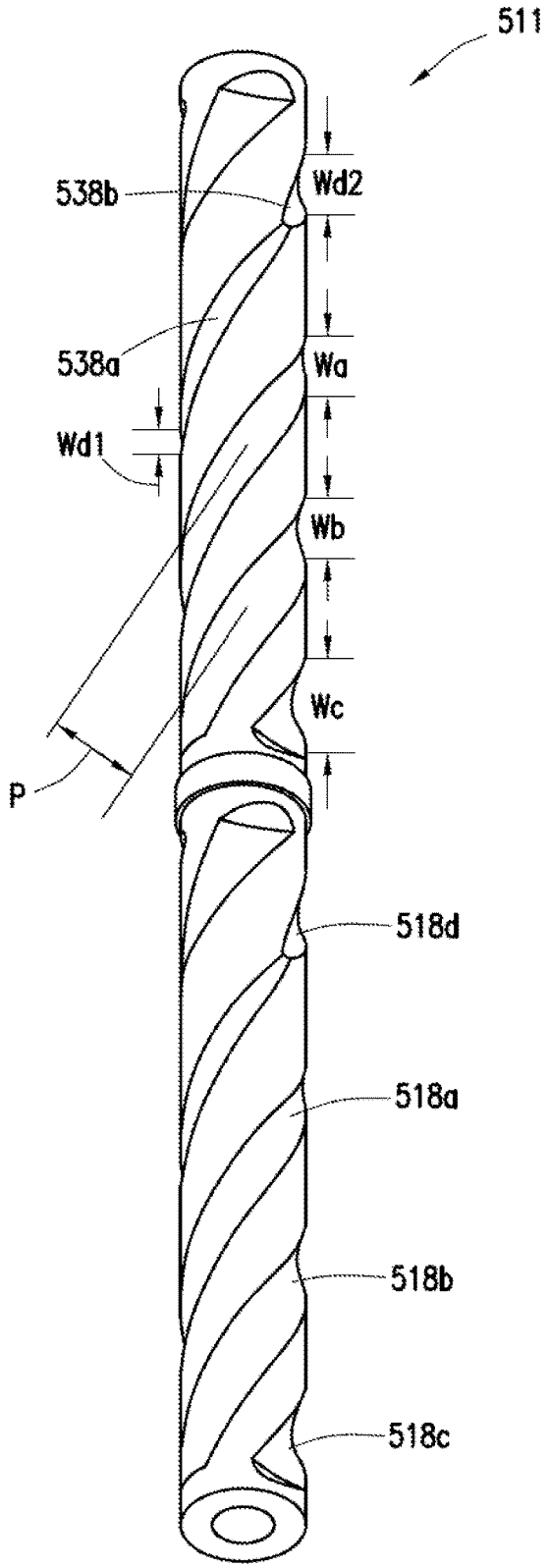

FIGS. 5A and 5B show a portion of a hole cleaning joint 511 including a hole cleaning pad 520 with a hole cleaning section 516 having a dual spiral configuration. As shown by this view, the hole cleaning joint 511 may be similar to the hole cleaning joint 311, except that the hole cleaning section 516 and grooves 518*a-d* have a different configuration. As demonstrated by FIGS. 5A and 5B, the hole cleaning section 516 may be provided with the spiral grooves 518*a-d* having different dimensions, and one or more sets 536*a,b* of the spiral grooves 518*a-d* may be provided. Some of the grooves 518*a-d* may have continuous width and depth, and some may have varied widths and depths.

In this version, the hole cleaning section 516 has a plurality of grooves 518*a-d* disposed about an outer surface 524 of the hole cleaning section 516. Each of the sets of grooves 536*a,b* are the same, with each of the individual grooves 518*a-d* having different dimensions. Grooves 518*a-c* each have the variable depths and variable widths Wa-c with a constant pitches P. Groove 518*d* has a first portion 538*a* with a first Wd1 and a second portion 538*b* with a second width Wd2. The outer surface 524 of the hole cleaning section 516 has a constant diameter terminating at ends 512*a,b*.

As shown in this view, two sets 536*a,b* of the grooves 518*a-d* extend along the hole cleaning section 516 separated by a peripheral ring 537. An uphole set 536*a* of the spiral grooves 518*a-d* extends between an uphole end 512*a* and the ring 537. A downhole set 536*b* of the spiral grooves 518*a-d* extends between the ring 537 and a downhole end 512*b*. The ring(s) 537 may define a bearing portion contactable with the wellbore wall. The hole cleaning section 516 terminates at the downhole end 512*b* and the uphole end 512*a* for connection to other devices (not shown), such as an end (e.g., 212*a,b* of FIG. 2A,2B) or a pipe body (e.g., 222 of FIG. 2). Additional ring(s) 537 may also be provided along the hole cleaning pad 520 and/or connected to another device (not shown), such as an end (e.g., 212*a,b* of FIG. 2) or a pipe body (e.g., 222 of FIGS. 2A,2B).

Figure 6A:
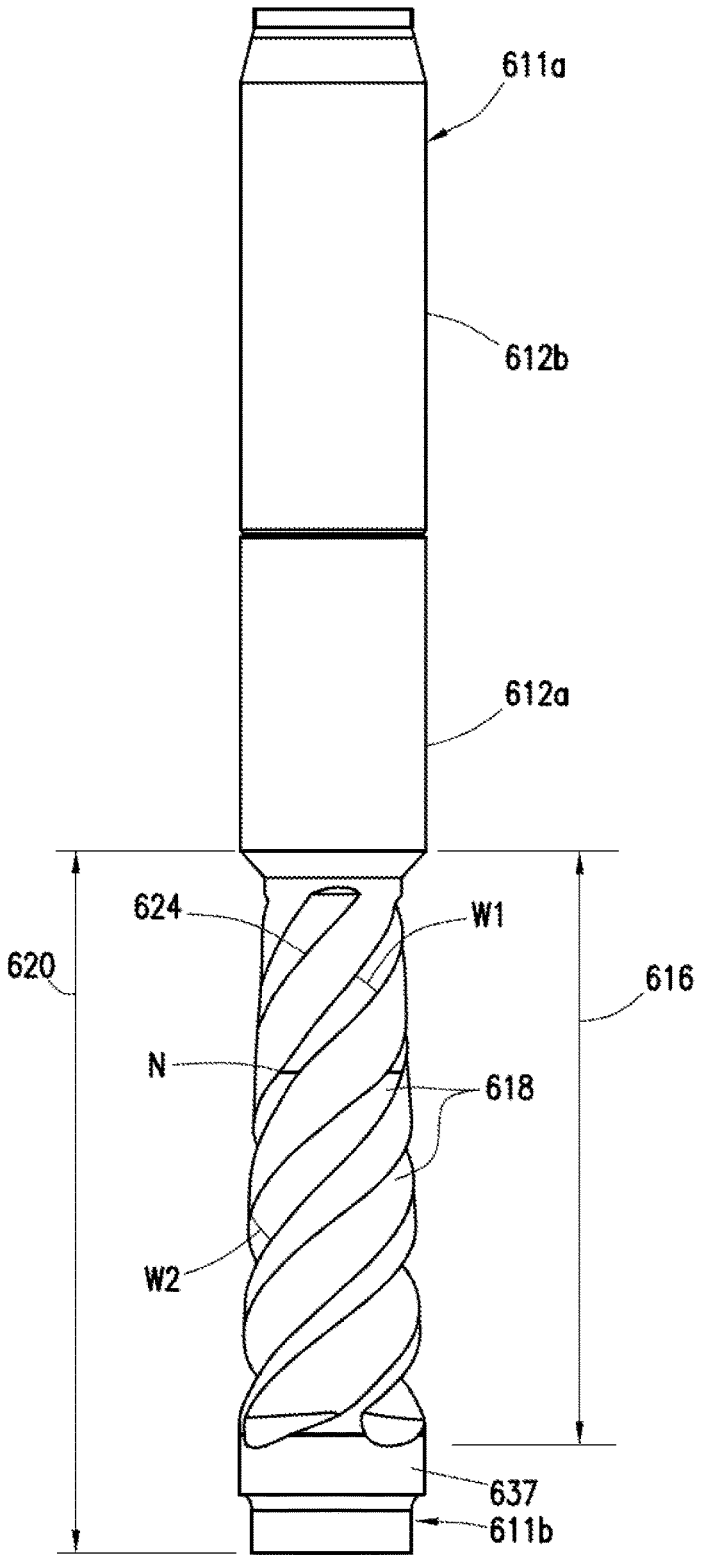
FIGS. 6A-6B depict plan and perspective views, respectively, of portions of adjacent hole cleaning joints including a hole cleaning pad with a variable spiral hole cleaning section.
Figure 6B:
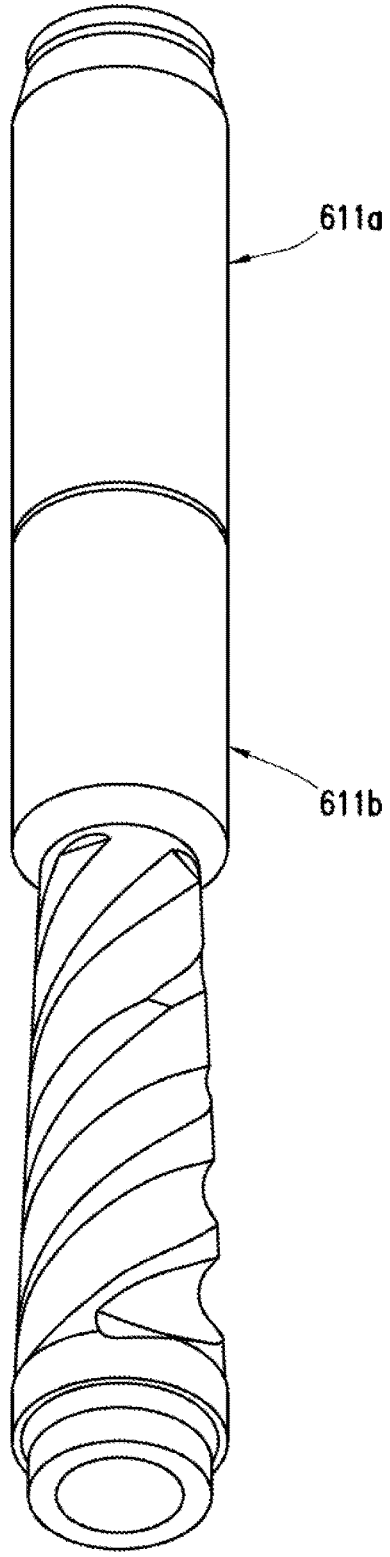

FIGS. 6A and 6B show portions of two adjacent joints 611*a,b*. The adjacent joints 611*a,b* may both be hole cleaning joints. In some cases, 611 may refer to a drill pipe joint, such as the drill pipe joint 215 of FIGS. 2A,2B. A portion of joint 611*a* is depicted as being connected to a portion of the adjacent hole cleaning joint 611*b*. The portion of the hole cleaning joint 611*a* includes an end 612*b* (e.g., pin end 212*b* of FIGS. 2A, 2B) connectable to the hole cleaning joint 611*b*. The hole cleaning joint 611*b* is depicted as including an end 612*a* (e.g., box end 212*a* of FIGS. 2A,2B) connectable to the end 612*b*. The hole cleaning section 616 terminates at a ring 637 at an end of the hole cleaning joint 611*b* opposite end 612*a*. The hole cleaning joints 611*a,b* may connect to a pipe portion (not shown, such as pipe body 222 of FIGS. 2A, 2B).

The hole cleaning joint 611*b* also includes a hole cleaning pad 620 with a hole cleaning section 616 having a single spiral configuration. The hole cleaning section 616 may be the same as the hole cleaning sections 536*b* of FIG. 5, except with a different groove configuration. As demonstrated by FIGS. 6A and 6B, the hole cleaning section 616 has a plurality of grooves 618 disposed about an outer surface 624 of the hole cleaning section 616. Each of the grooves 618 has a varied width and depth therealong. Grooves 618 have a width W2 at each end thereof with a narrowed width W1 therebetween. The grooves 618 narrow along an area N along each groove 618.

As also shown by FIGS. 6A and 6B, the outer surface 624 of the hole cleaning section 616 may taper. In the example shown, an outer diameter of the hole cleaning section 616 reduces from a downhole end towards end 612*a* uphole therefrom.

Figure 7A:
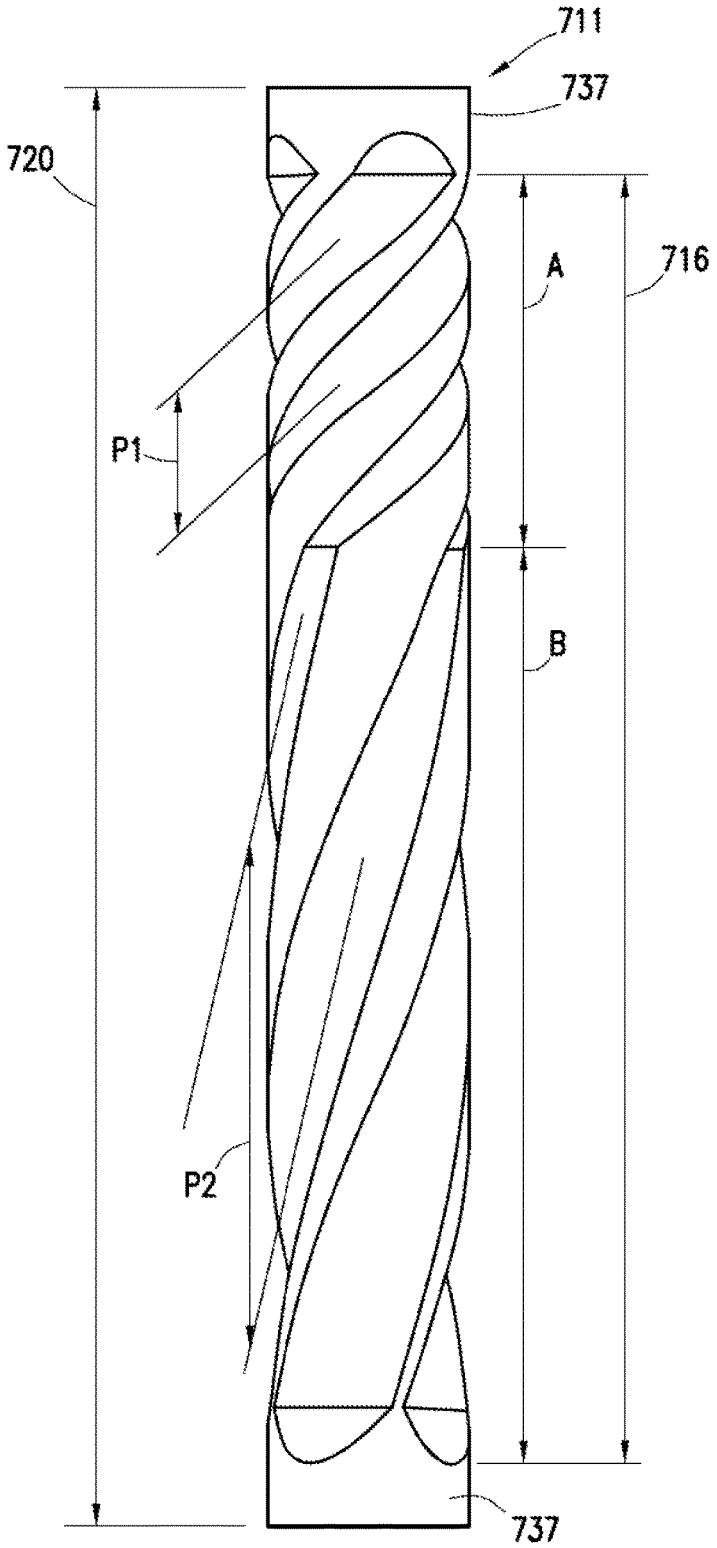
FIGS. 7A-7B depict plan and perspective views, respectively, of a portion of a hole cleaning joint including a hole cleaning pad with a mixed pitch spiral hole cleaning section.
Figure 7B:
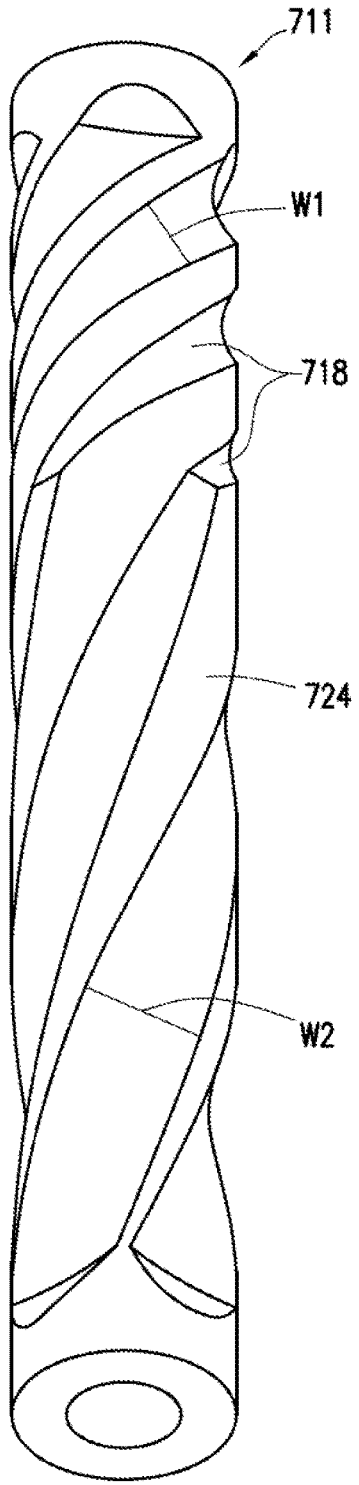

FIGS. 7A and 7B show a portion of a hole cleaning joint 711 including a hole cleaning pad 720 having a hole cleaning section 716 with a mixed pitch spiral configuration. As shown by this view, the hole cleaning section 716 may be similar to the hole cleaning section 516 (FIG. 5), except that the hole cleaning pad 720 and grooves 718 have a different configuration. The hole cleaning pad 720 has grooves 718 extending therein and terminating at rings 737. The hole cleaning pad 720 may optionally taper from a larger uphole end to a smaller downhole end (or vice versa). As also shown in this version, the rings 737 are integrally formed with the hole cleaning section 716.

As demonstrated by FIGS. 7A and 7B, the hole cleaning joint 711 may include grooves 718 with varied width, depth and pitches P1 and P2 extending along a length of the hole cleaning section 716. In this version, the hole cleaning section 716 has a plurality of grooves 718 disposed about an outer surface 724 of the hole cleaning section 716. As shown in this view, each of the grooves 718 has a first pitch P1 and a first width W1 along a first portion A of the hole cleaning section 716, and a second pitch P2 and a second width W2 along a second portion B of the hole cleaning section. The pitch P1 is shallower than the pitch P2, and the width W2 is greater than width W1. In some cases, the depth and width of the grooves 718 may be constant along the length of the hole cleaning section 716.

The varied pitches P1, P2 are at angles that may be used to provide deeper and wider spiral grooves towards a downhole (or leading) end of the hole cleaning joint 711. The profile of the grooves 718 may become shallower and narrower as the grooves 718 progress uphole along the hole cleaning section 716. This configuration may be used to encourage gathering of cuttings as the hole cleaning joint 711 enters a new section of the wellbore to be cleared of cuttings.

The size and volume of the grooves 718 may decrease toward an uphole end of the hole cleaning section 716. As the cuttings move upwards about the hole cleaning section 716, a velocity of the cuttings may be accelerated, propelling the cuttings up and out of the wellbore at an increasing rate. The grooves 718 may gradually become shallower and narrower to accelerate movement of the cuttings and/or the flow of drilling fluid.

Toward the downhole end of the hole cleaning section 716, a profile of the grooves 718 may also have an increased width and depth to promote dispersion of the cuttings and/or to prevent accumulation on a downhole side of the wellbore, for example, along obstructions in the wellbore (e.g., as ledges, key seats, tight spots and washed out sections of the wellbore).

FIGS. 8-12B show various configurations of hole cleaning joints 811-1211 including various combinations of hole cleaning pads 820-920 and pipe bodies 822-922. The hole cleaning joints may include various combinations of one or more hole cleaning sections with various hole cleaning sections 816-916 having various groove geometries to address different hole cleaning challenges that might be encountered during drilling operations.

Figure 8:
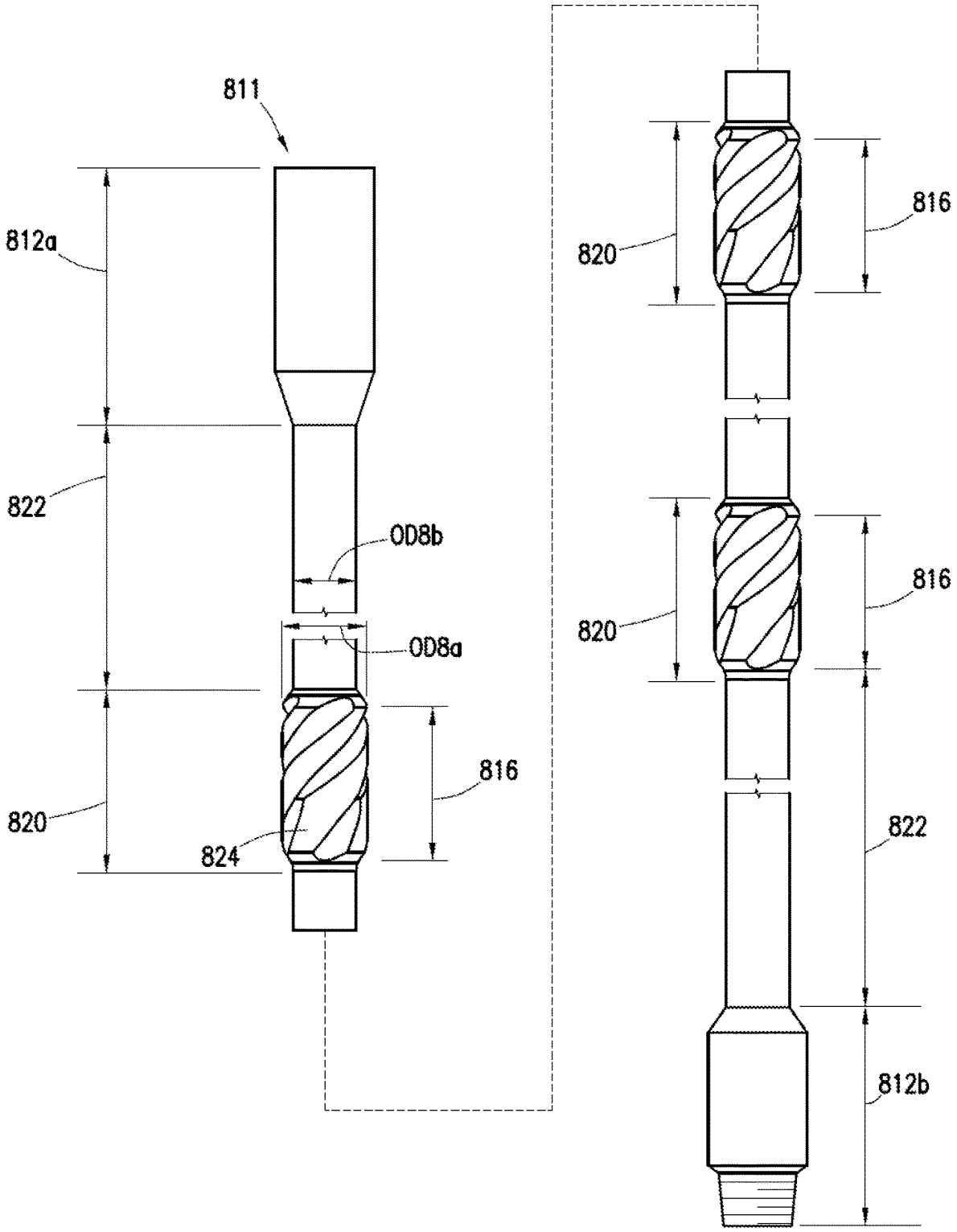
FIG. 8 depicts a plan view of a hole cleaning joint including multiple hole cleaning sections with mixed pitch spiral hole cleaning sections.

FIG. 8 shows a hole cleaning joint 811 including multiple hole cleaning pads 820. The hole cleaning pads 820 include hole cleaning sections 816 in a mixed pitch spiral configuration. The hole cleaning joint 811 includes connections with pin and box ends 812*a,b* at each end thereof with multiple hole cleaning sections 816 and pipe bodies 822 therebetween.

The box end 812*a* and a pin end 812*b* are at each end of the hole cleaning joint 811 for connection to an adjacent tubular (e.g., drill pipe joint 215 of FIGS. 2A, 2B). The box end 812*a* and the pin end 812*b* may be operatively connectable to or integral with the pipe bodies 822 adjacent thereto. While different ends 812*a,b* are depicted, similar ends may optionally be provided.

As shown, three identical hole cleaning sections 816 are provided between the tubular connections 812*a,b* with pipe bodies 822 therebetween. The hole cleaning joints 811 may include one or more of the same or different hole cleaning pads 820 and/or hole cleaning sections 816. Each of the hole cleaning sections 816 may have a mixed pitch spiral configuration similar to the hole cleaning section 716 of FIG. 7A or another configuration.

The hole cleaning joint 811 may have various diameters along the outer surface thereof to facilitate removal of cuttings. For example, hole cleaning sections 816 may have an overall outer diameter of OD8*a*. The hole cleaning section 816 may have a tapered outer surface 824 that tapers away from a central portion of the hole cleaning section 816 to the pipe bodies 822 on either side thereof. The pipe bodies 822 may have a reduced diameter OD8*b*. The pin and box ends 812*a,b* may have an outer diameter similar to the outer diameter OD8*a*.

Figure 9A:
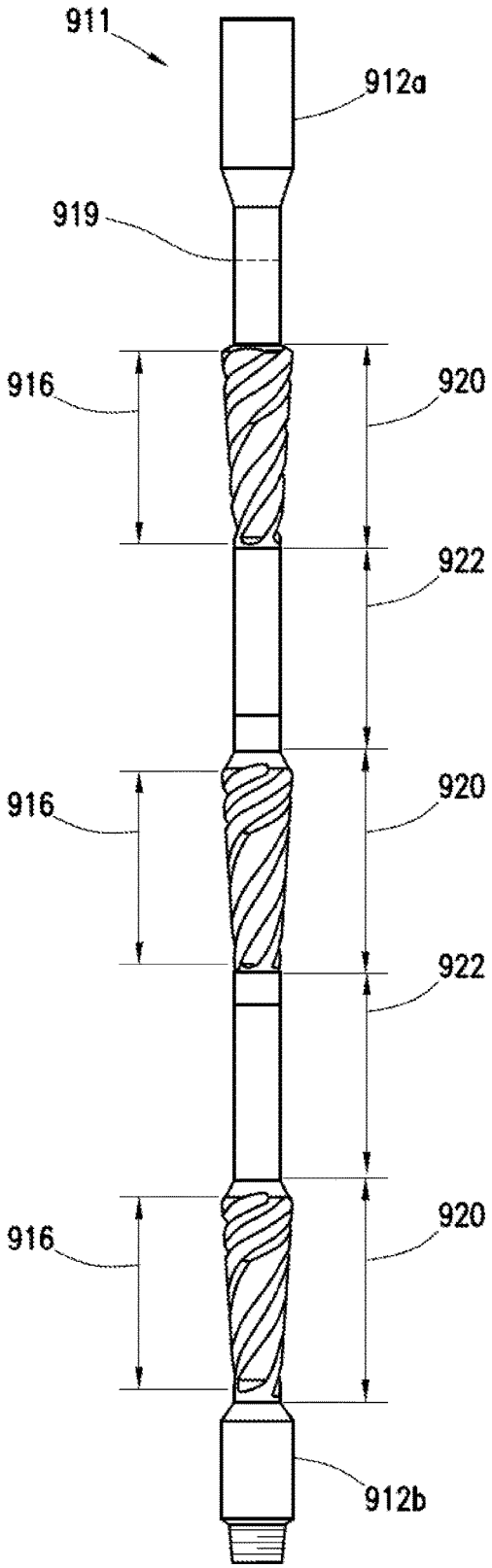
FIGS. 9A-9B, 10A-10B, 11A-11B, 12A-12B depict perspective views of various configurations of hole cleaning joints including multiple hole cleaning sections with tapered, mixed pitch, spiral hole cleaning sections.

FIGS. 9A-12B show configurations of a hole cleaning joints 911-1211 having multiple hole cleaning pads 920 having tapered hole cleaning sections 916 in a tapered mixed pitch spiral configuration. FIG. 9A shows a hole cleaning joint 911 including ends 912*a,b* with three tapered hole cleaning sections 916 and two pipe bodies 922 therebetween. Each of the hole cleaning pads 920 has identical tapered hole cleaning sections 916 with grooves 918 in a tapered mixed pitch spiral configuration. FIG. 9B shows an alternate view with a length of the pipe bodies 922 as shown reduced.

As shown in FIG. 9A, the three hole cleaning sections 916 are the same, but optionally could be different. The hole cleaning sections 916 may be similar to the sections 816 of FIG. 8 with grooves 918 in a mixed pitch spiral configuration. In this version, the hole cleaning section 916 has a tapered outer surface 924 that extends from a maximum outer diameter OD9*a* at an uphole end to a smaller diameter OD9*b* at the pipe body 922 at a downhole end thereof. As shown by lines 919, the hole cleaning joint 911 may be include one or more modular hole cleaning sections 911 or other components that may optionally be attached, for example, by welding.

The hole cleaning joint 911 may have various diameters along the outer surface 924 thereof to facilitate removal of cuttings. For example, the hole cleaning joint 911 may have an overall outer diameter of OD9*a*. A reduced diameter OD9*b* may be provided along portions of the hole cleaning assembly 914, such as along the pipe bodies 922 and/or ends 912*a,b*. A reduced diameter may also be provided along the tapered outer surface 924 of the hole cleaning sections 916.

Figure 10A:
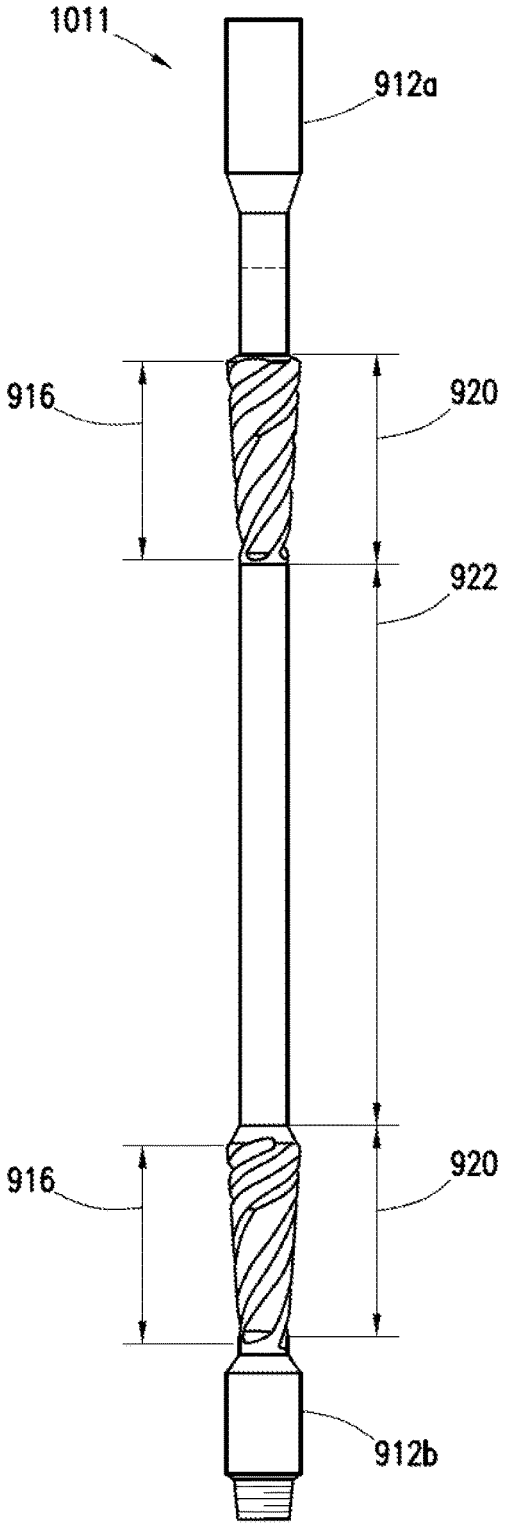
Figure 9B:
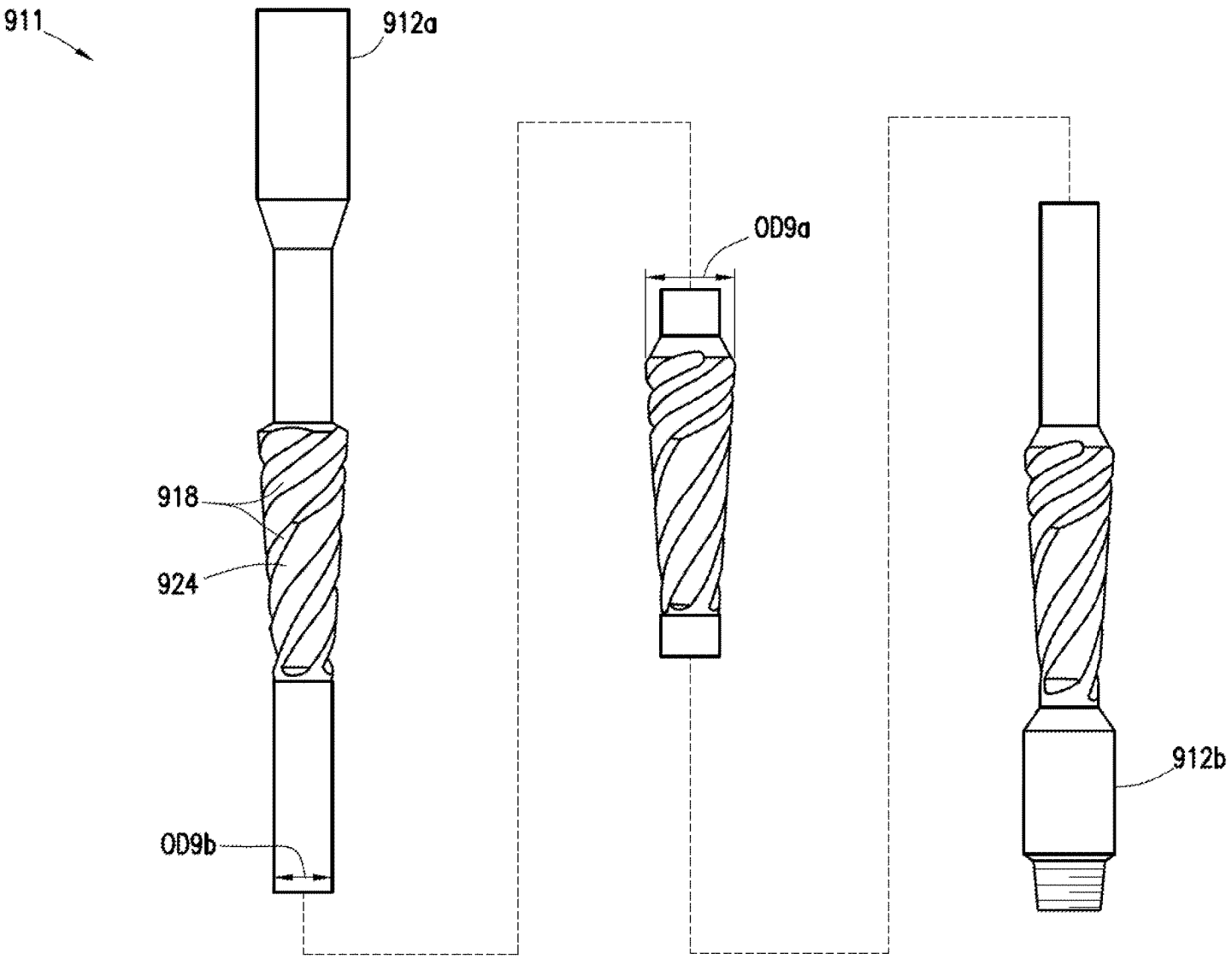
Figure 10B:
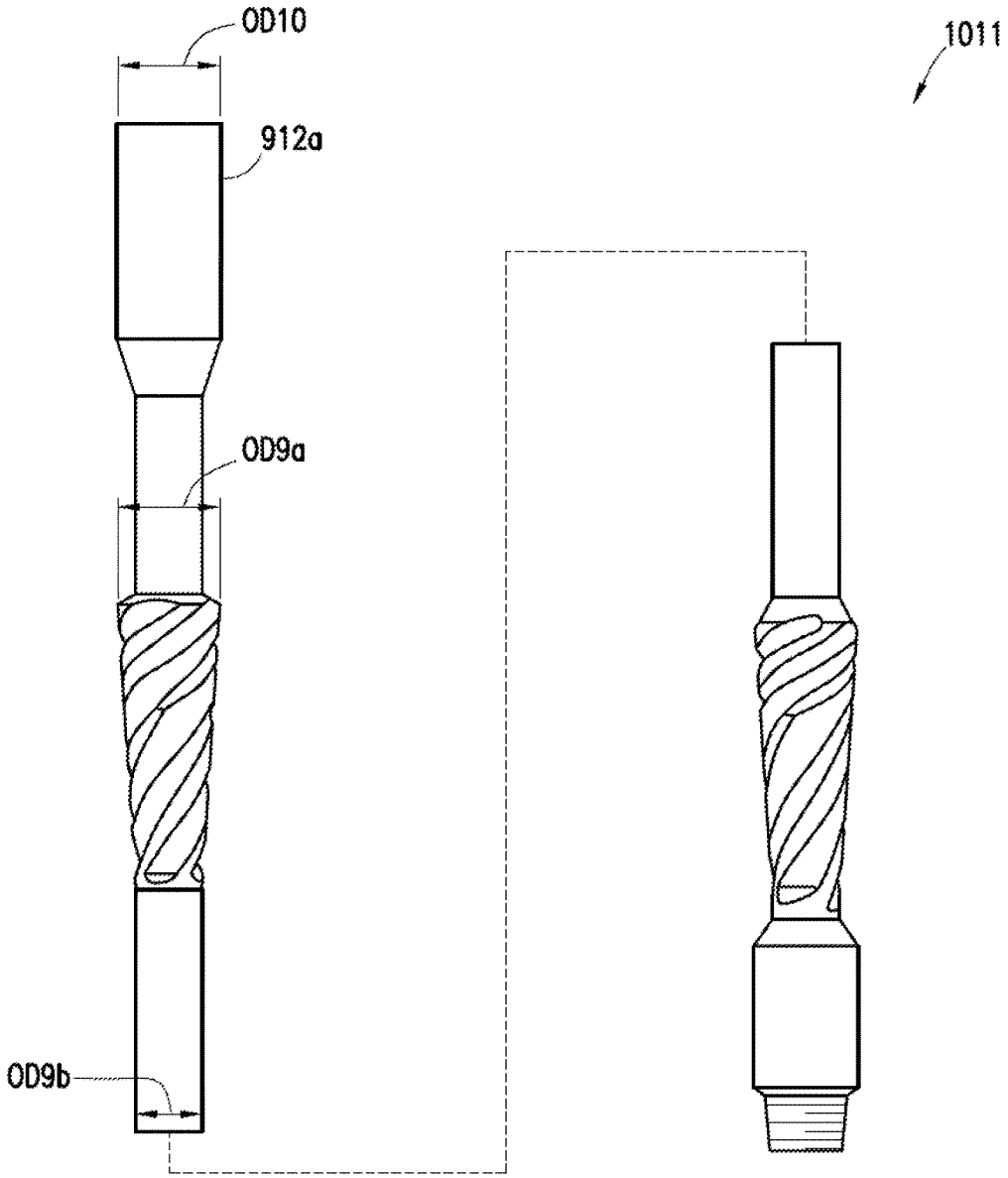

FIGS. 10A and 10B show an alternate version of the hole cleaning joint 1011. As shown in FIG. 10A, this version is the same as the hole cleaning joint 911, except that the ends 912*a,b* have two hole cleaning sections 916 and a single pipe body 922 therebetween, and that an outer diameter OD10 of the end 912*a* is greater than the outer diameter OD9*b* of the tapered hole cleaning tool section 916. FIG. 10B shows the hole cleaning joint 1011 with the pipe body 922 reduced.

Figure 11A:
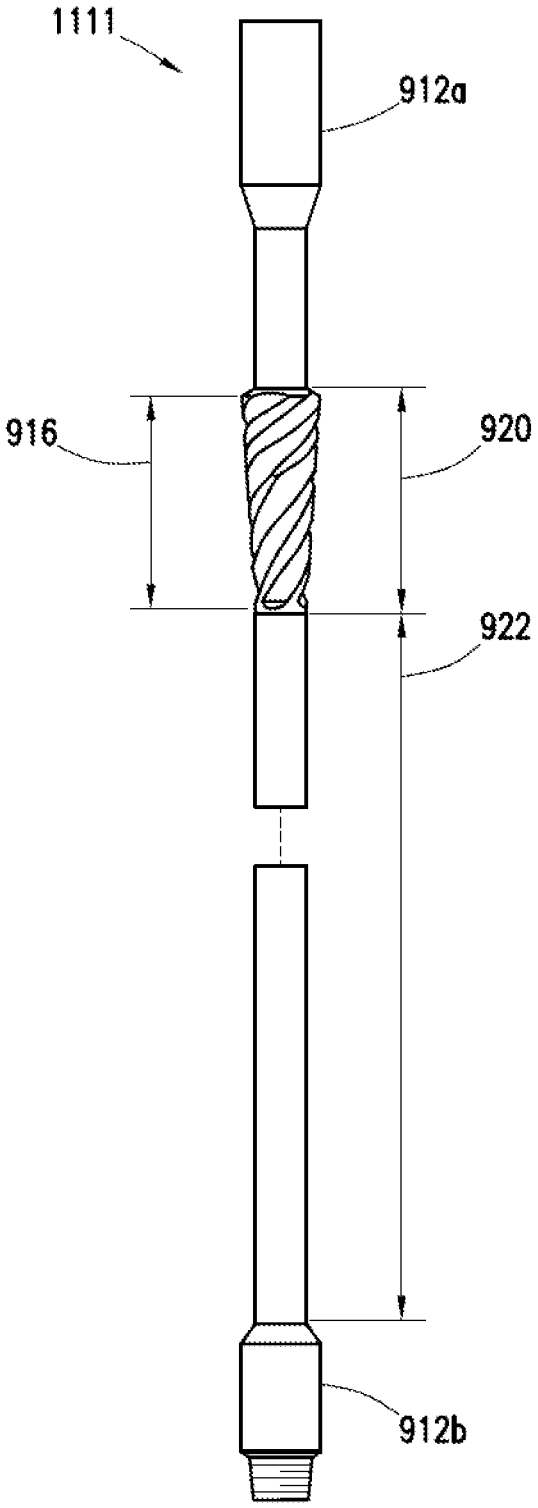
Figure 11B:
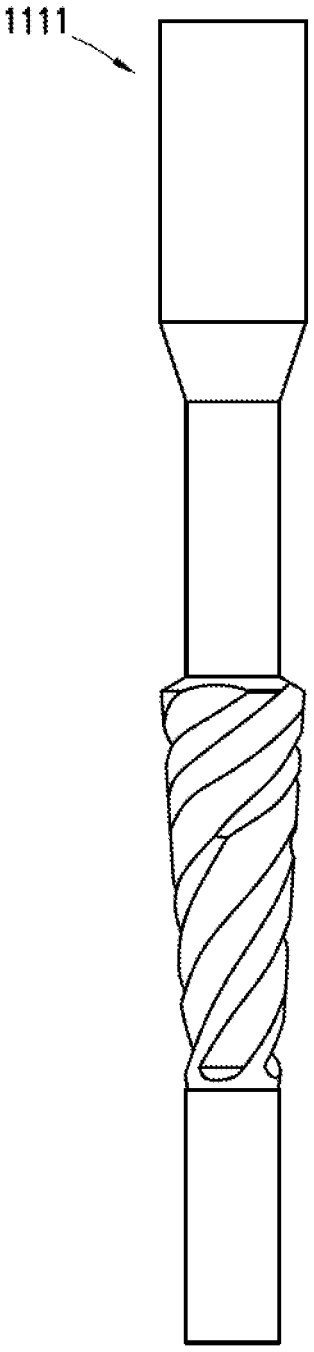

FIGS. 11A and 11B show another alternate hole cleaning joint 1111. As shown in FIG. 11A, this version is the same as the hole cleaning joint 911, except that the ends 912*a,b* have one hole cleaning pad 920 with one hole cleaning section 916 and a single pipe body 922 therebetween. The hole cleaning section 916 is positioned uphole from the single pipe body 922. FIG. 11B shows the hole cleaning joint 1111 with the pipe body 922 reduced and end 912*b* removed.

Figure 12A:
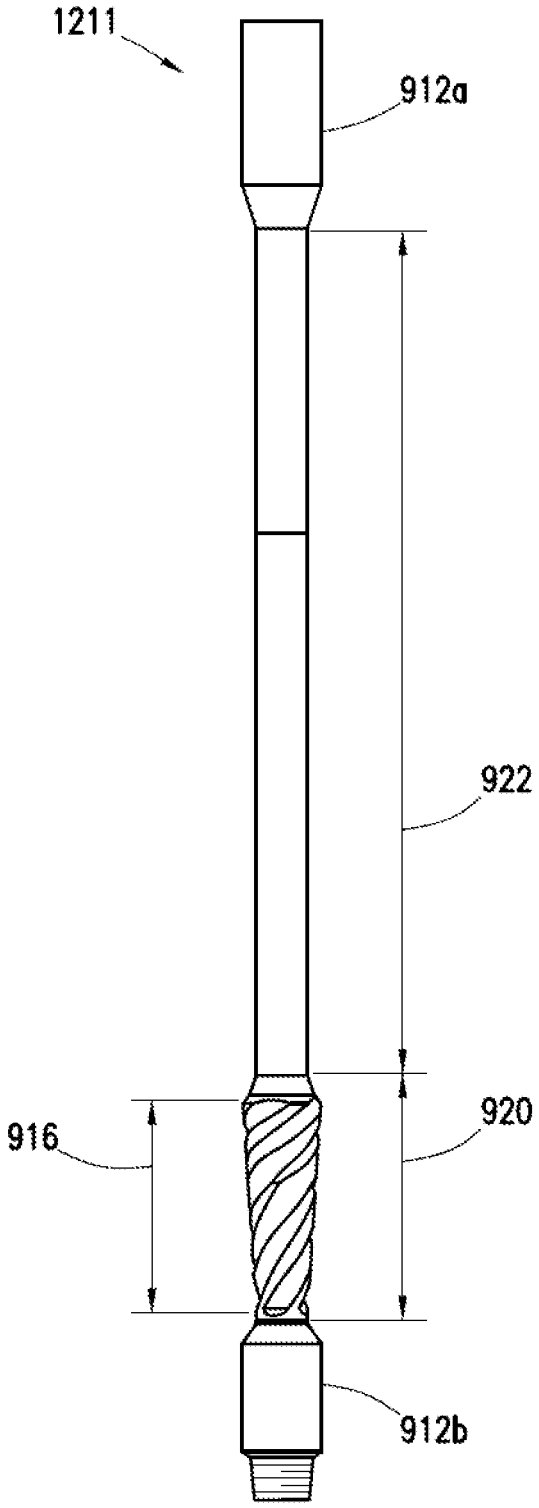
Figure 12B:
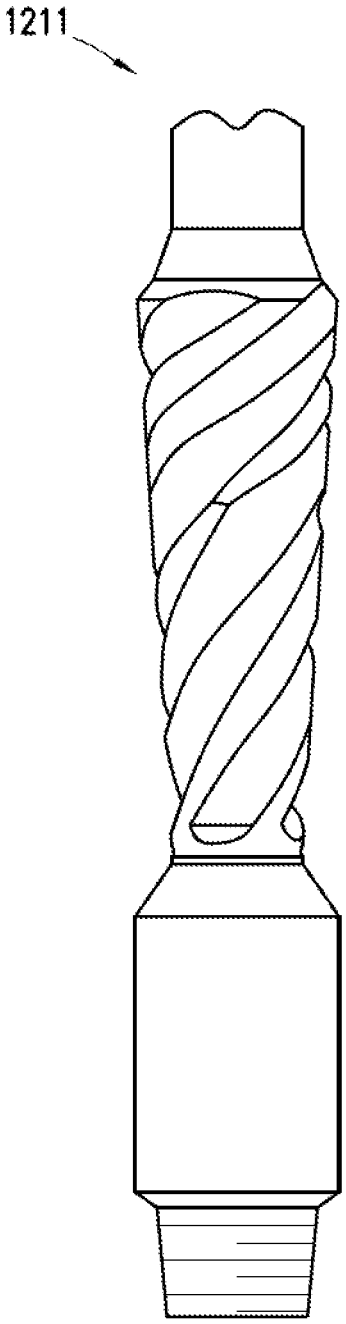

FIGS. 12A and 12B show another alternate hole cleaning joint 1211. As shown in FIG. 12A, this version is the same as the hole cleaning joint 911 of FIG. 11, except that the ends 912*a,b* have one hole cleaning pad 920 with one hole cleaning section 916 and a single pipe body 922 in a different order therebetween. The hole cleaning section 916 is positioned downhole from the single pipe body 922. FIG. 12B shows the hole cleaning joint 1211 with the pipe body 922 reduced and end 912*a* removed.

When forming the various hole cleaning pads and/or joints herein, portions of the tubular may be formed, for example, by welding the hole cleaning section to the downhole end of the hole cleaning joint just above the downhole connector (e.g., pin or box end) as shown, for example in FIG. 12A. In another example, the hole cleaning section may be welded a distance (e.g., about 144" (3.66 m) from an uphole end of the uphole connector (e.g., pin or box end) of the hole cleaning joint. An example is shown in FIG. 9A by lines 919 indicating joining of portions of the tubular.

The hole cleaning section position may be optimized at a distance, for example far enough from the downhole connector to perform the desired hole cleaning. The hole cleaning section may be as close to the downhole end as possible to reduce the weight and size of the hole cleaning joint and/or be long enough to create a hydraulic actuation to release fluid on a downhole side of the drillstring. The spiral shape of the grooves along the hole cleaning section may be at an angle (e.g., up to about 80 degrees) to release fluid and at a velocity to facilitate movement of cuttings at a velocity flow on an uphole side of the hole cleaning joint.

Figure 13:
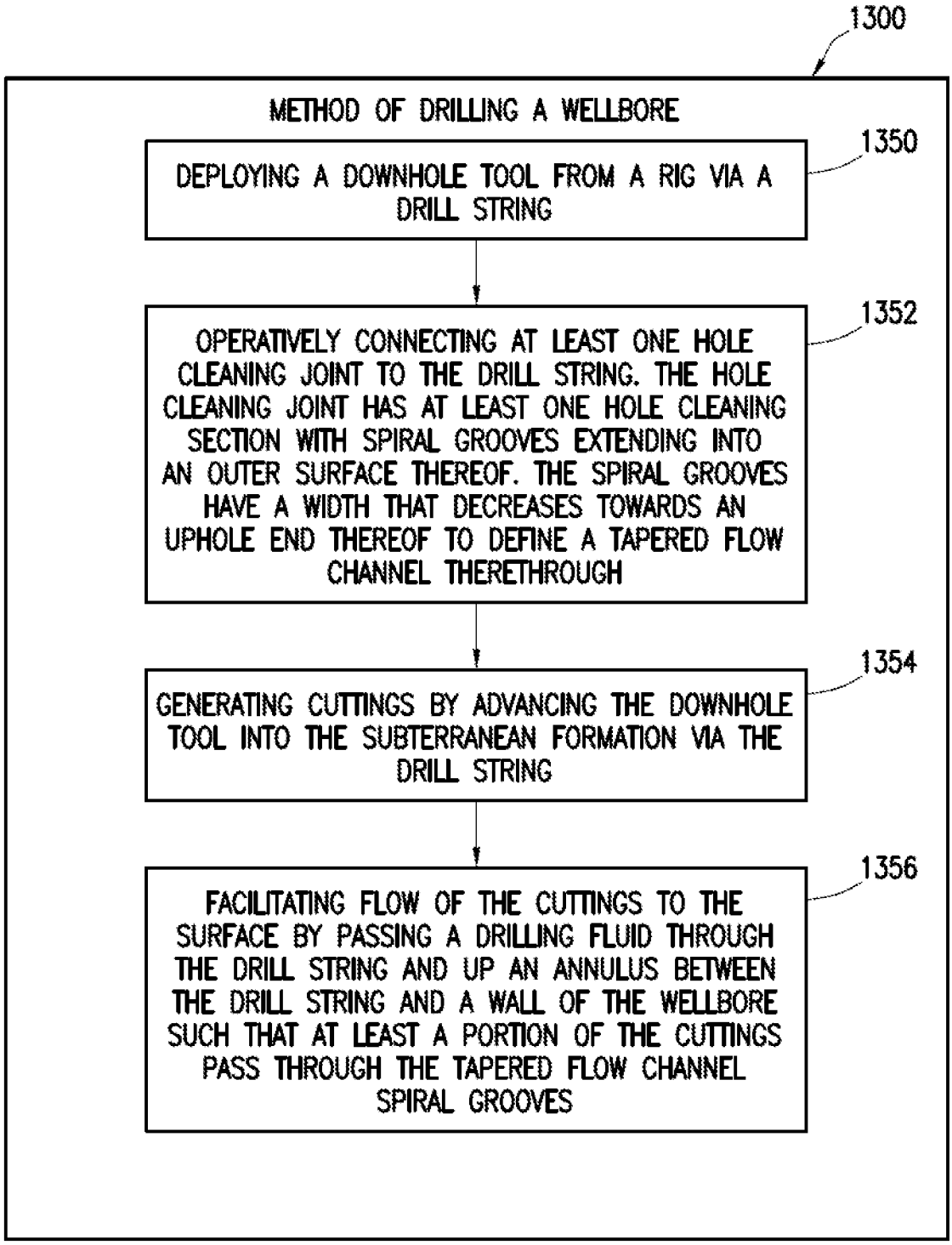
FIG. 13 is a flow chart depicting a method of drilling a wellbore.

FIG. 13 is a flow chart depicting a method 1300 of drilling a wellbore. The method involves 1350—deploying a downhole tool from a rig via a drill string (see, e.g., FIG. 1). The method further involves 1352—operatively connecting at least one hole cleaning joint to the drill string. The hole cleaning joint has at least one hole cleaning section with spiral grooves extending into an outer surface thereof. The spiral grooves have a width that decreases towards an uphole end thereof to define a tapered flow channel therethrough.

The method also involves 1354—generating cuttings by advancing the downhole tool into the subterranean formation via the drill string, and 1356—facilitating flow of the cuttings to the surface by passing a drilling fluid through the drill string and up an annulus between the drill string and a wall of the wellbore such that at least a portion of the cuttings pass through the tapered flow channel of the spiral grooves. The method may be performed in any order and repeated as desired.

While specific configurations of hole cleaning sections, joints and/or assemblies are provided, various combinations of hole cleaning sections, joints and/or assemblies may be provided alone or in combination with various ends, joints, rings, and/or other features along the drill string. Various geometries of the various components may also be provided.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the disclosure may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more hole cleaning tools, wear pad, hole cleaning sections, pipe bodies, ends, connections, tubulars and/or other features as provided herein may be utilized along the drill string. In another example, a variety of geometries may be used for the wear pads, hole cleaning sections and grooves extending therein.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A hole cleaning joint for a drill string deployable into a wellbore penetrating a subterranean formation, comprising:

a tubular body connectable to the drill string and comprising a pair of connectors positioned at opposing ends of the tubular body; and a hole cleaning section positioned between the pair of connectors of the tubular body and that is integral with the tubular body, the hole cleaning section having an outer surface engageable with a wall of the wellbore and defining a maximum outer diameter of the hole cleaning joint that is greater than an outer diameter of any other portion of the tubular body and which tapers gradually from the hole cleaning section to the pair of connectors, the outer surface having spiral grooves extending therein defining blades therebetween, the spiral grooves each having a sloped portion and an inclined portion with an obtuse angle therebetween, and a location of both maximum width and maximum depth, the location of both maximum width and maximum depth comprising a longitudinally extending portion of the spiral groove, and the spiral grooves each defining a spiral cavity between an uphole and a downhole end thereof;

wherein the maximum outer diameter of the hole cleaning joint tapers smoothly, cornerlessly, and featurelessly along a first tapered end extending from the hole cleaning section to the first connector, and along a second tapered end extending from the hole cleaning section to the second connector, and wherein the second tapered end has a greater axial length than the first tapered end;

wherein each spiral cavity has a width and depth that decrease from the location of maximum width and maximum depth to the uphole end and the downhole end respectively, each end of each spiral cavity terminating in a tapered rounded point, whereby each spiral cavity defines a tapered flow channel to receive cuttings therethrough whereby uphole movement of cuttings is facilitated during drilling.

2. The hole cleaning joint of claim 1, wherein at least one of the pair of connectors comprise at least one of a sleeve, a coupling, an internal thread, a threaded end, a ring, a pin end, and a box end.

3. The hole cleaning joint of claim 1, wherein a cross-section of the hole cleaning section has a pinwheel shape defined by a plurality of the blades with a plurality of spiral grooves therebetween, the sloped portion and the inclined portion of each spiral groove having a localized agitation area therein.

4. The hole cleaning joint of claim 1, wherein the spiral grooves comprise a pair of mirrored grooves.

5. The hole cleaning joint of claim 1, wherein the spiral grooves have an uphole portion, an intermediate portion, and a downhole portion with peripheral depressions therebetween.

6. The hole cleaning joint of claim 1, wherein the spiral grooves have multiple pitches.

7. The hole cleaning joint of claim 6, wherein the multiple pitches comprise a first pitch and a second pitch, the first pitch greater than the second pitch.

8. The hole cleaning joint of claim 1, further comprising at least one ring.

9. The hole cleaning joint of claim 8, wherein at least one end of the hole cleaning section terminates at the at least one ring.

10. The hole cleaning joint of claim 8, wherein a diameter of the hole cleaning section tapers to the at least one ring.

11. The hole cleaning joint of claim 1, wherein the spiral grooves have a helical shape.

12. The hole cleaning joint of claim 1, wherein the spiral grooves are oriented in the direction of rotation.

13. The hole cleaning joint of claim 1, wherein a portion of the width of the spiral grooves increases between the uphole and downhole ends thereof.

14. The hole cleaning joint of claim 1, wherein the spiral groove narrows at a location between the uphole end and the downhole end thereof.

15. The hole cleaning joint of claim 1, wherein the hole cleaning section has an end operatively connectable to at least one of the pair of connectors.

16. The hole cleaning joint of claim 1, wherein the hole cleaning section has an outer diameter that reduces from an uphole end and to a downhole end thereof.

17. The hole cleaning joint of claim 1, wherein the hole cleaning section is integral with respect to the tubular body.

18. The hole cleaning joint of claim 1, wherein the hole cleaning section comprises a plurality of hole cleaning sections with at least one of the tubular bodies therebetween.

19. The hole cleaning joint of claim 1, wherein the spiral grooves have an angle, width, depth, pitch, and orientation to facilitate flow of the cuttings uphole through the flow channel.

20. The hole cleaning joint of claim 1, wherein the hole cleaning section has a defined outer diameter, shape, length, and orientation to facilitate flow of the cuttings uphole through the flow channel.

21. A hole cleaning system for drilling a wellbore penetrating a subterranean formation, comprising:

a drill string deployable from a rig;

a bottomhole assembly carried by the drill string; and a hole cleaning joint wherein at least a portion of the drill string extends between the bottomhole assembly and the hole cleaning joint, and wherein the hole cleaning joint comprises:

a tubular body connectable to the drill string and comprising a pair of connectors positioned at opposing ends of the tubular body; and a hole cleaning section positioned between the pair of connectors of the tubular body and that is integral with the tubular body, the hole cleaning section having an outer surface engageable with a wall of the wellbore, the outer surface having spiral grooves extending therein defining blades therebetween, the spiral grooves each having a location of both maximum width and maximum depth, the location of both maximum width and maximum depth comprising a longitudinally extending portion of the spiral groove, and the spiral grooves each defining a spiral cavity between an uphole and a downhole end thereof;

wherein the outer surface of the hole cleaning section defines a maximum outer diameter of the hole cleaning joint that is greater than an outer diameter of any other portion of the tubular body and which tapers gradually from the hole cleaning section to the pair of connectors;

wherein the maximum outer diameter of the hole cleaning joint tapers smoothly, cornerlessly, and featurelessly along a first tapered end extending from the hole cleaning section to the first connector, and along a second tapered end extending from the hole cleaning section to the second connector, and wherein the second tapered end has a greater axial length than the first tapered end;

wherein each spiral cavity having a width and depth that decrease to the uphole end and the downhole end respectively, each end of each spiral cavity terminating in a tapered rounded point, whereby each spiral cavity defines a tapered flow channel to receive cuttings therethrough whereby uphole movement of cuttings is facilitated during drilling.

22. The hole cleaning system of claim 21, wherein the drill string comprises at least one tubular and at least one of the hole cleaning joints, the tubular comprising at least one of a drill pipe, drill collars, heavy weight drill pipe, sleeve, collar, and combinations thereof.

23. The hole cleaning system of claim 21, wherein the drill string comprises pairs of drill pipe and a plurality of hole cleaning joints, one of the plurality of hole cleaning joints being operatively connected to each pair of drill pipe of the drill string.

24. The hole cleaning system of claim 21, wherein the hole cleaning joint comprises a plurality of the hole cleaning sections connected to at least one of the tubular bodies.

25. The hole cleaning section of claim 24, wherein at least one of the pair of connectors of the tubular body is matably connectable to a connector of an adjacent hole cleaning joint to form at least a portion of the drill string.

* * * * *